US005748082A

United States Patent [19]

Payne

[11] Patent Number: 5,748,082

[45] Date of Patent: May 5, 1998

[54] LIGHT SENSITIVE SWITCH FOR ALERTING DEVICES

[76] Inventor: Kenneth Ray Payne, 5673 Descartes Cir., Boynton Beach, Fla. 33437

[21] Appl. No.: 347,554

[22] Filed: Nov. 29, 1994

[51] Int. Cl.[6] ..... G08B 13/14; G09F 1/00

[52] U.S. Cl. ..... 340/568; 340/573; 340/555; 340/691; 340/693; 340/384.6; 40/124.1; 40/455; 362/98; 434/317

[58] Field of Search ..... 340/568, 500, 340/573, 555, 384.6, 384.73, 691, 693, 384.71; 40/124.1, 455; 362/98, 99; 84/649, 601, 730, 671, DIG. 1; 434/236, 309, 311, 317

[56] References Cited

U.S. PATENT DOCUMENTS

| | | | |
|---|---|---|---|
| 4,055,014 | 10/1977 | Schmidt | 40/28.3 |
| 4,299,041 | 11/1981 | Wilson | 40/124.1 |
| 4,363,081 | 12/1982 | Wilbur | 40/124.1 |
| 4,497,126 | 2/1985 | Dejean | 40/124.1 |
| 4,611,262 | 9/1986 | Galloway et al. | 361/421 |
| 4,692,745 | 9/1987 | Simanowitz | 340/568 |
| 4,703,573 | 11/1987 | Montgomery et al. | 434/317 |
| 4,719,453 | 1/1988 | Beck et al. | 340/568 |
| 4,726,771 | 2/1988 | Weinblatt | 340/568 |
| 4,778,391 | 10/1988 | Weiner | 434/317 |
| 4,791,741 | 12/1988 | Kondo | 40/124.1 |
| 4,939,326 | 7/1990 | Weinblatt | 200/61.19 |
| 5,290,190 | 3/1994 | McClanahan | 434/317 |
| 5,374,195 | 12/1994 | McClanahan | 434/317 |

*Primary Examiner*—Donnie L. Crosland
*Attorney, Agent, or Firm*—Gregg Rasor

[57] ABSTRACT

A light sensitive switch for the activation of an alerting circuit (70) to be used as an electronic alerting device (50). Alerting device (50) may be used in publications such as a magazine (78) or book (94) to enhance the printed material by audio visual and/or mechanical vibration means. A photosensor (52) is used to detect ambient light when the publication is opened to an activation page (86) where the enhancement is located. Photosensor (52) switches on a transistor (66) when exposed to light, which in turn switches on alerting circuit (70). Alerting circuit (70) may consist of an audio transducer (74), a lamp (76), a motor (128), a solenoid (136), a mechanical vibrator or any combination of these. Pages are used to block ambient light from photosensor (52) when the publication is closed, thus turning off alerting device (50).

20 Claims, 29 Drawing Sheets

LIGHT SENSITIVE SWITCH FOR ALERTING DEVICES

BACKGROUND—FIELD OF INVENTION

This invention is generally related to electronic alerting devices. More particularly, this invention relates to electronic circuits inserted into magazines, books, greeting cards, or the like, which are used for advertising or other purposes.

BACKGROUND—DISCUSSION OF PRIOR ART

Various techniques have been used to activate electronic circuits inserted into magazines, greeting cards, and talking books. The electronic circuits are used to alert the reader by enhancing the printed material with audio or visual devices. The audio could be a melody or recorded speech in order to tell a story. The visual enhancement could include illumination or motion. These techniques have included mechanical components which can be costly and typically hinder the printing and binding equipment used to manufacture a periodical. The terms "periodical" or "magazine" are used herein to include any type of publication. Mechanical switches are also prone to damage as they are processed through binding or printing equipment. The switch needs to withstand the pressures and bending associated with the printing and binding processes. Thus, what is needed is a non-mechanical switch, which is inexpensive and tends not to be damaged by or slow down printing or binding equipment used to manufacture a periodical.

Greeting cards have included electronic circuits that perform some function such as playing a tune. These circuits are comprised of a printed circuit board to which may be connected a PROM, a battery, a piezoelectric transducer, and a switch. The switch typically hangs loose from the circuit board via electrical leads and extends outwardly from the circuit board. These two assemblies are then adhesively mounted into the greeting card such that when the card is opened the circuit function or alert is activated and when the card is closed the alert is deactivated. If the switch is not mounted to the printed circuit board, it is soldered via wire connections. These components are adhesively mounted into the greeting card-separately. This process is costly and time consuming. Thus, what is needed is a switch that can be soldered directly to the printed circuit board to form a single unit and eliminate the need to solder interconnecting wires.

One type of switch used in greeting cards consists of a moving leaf of insulating material connected to the facing page and threaded between two conducting members on the page holding the electronic device. As the card is opened, the leaf is pulled from the conducting members, applying power to the circuit to be activated. As the card is closed, the insulating leaf is threaded back between the conducting members, thereby removing power from the electrical circuit. The conducting members are usually stamped metal and must be connected to the printed circuit board by some means. They may be either soldered by wire or pressure fit to the printed circuit board. The stamped metal switch is not very flat and will damage easily if pressure is applied to its spring members. This type of switch has to be located near the backbone or fold of the card since activation is dependent on the facing page being opened. This switch therefore limits the electronic device's possible locations on the printed page if the switch and electronic device are to form a single unit. This type of switch also requires cutting, folding and threading processes to form the insulating leaf which is inserted into the switching mechanism. To obtain additional locations for the electronic device on the page, the switch must be separated from the unit, and connected by wires. The switch and electronic alerting device then have to be mounted into the greeting card separately. Thus, what is needed is a switch that does not depend on a mechanical interconnection to any other page in the periodical and does not include moving mechanical members which are easily damaged. The switch also needs to allow the audio and/or visual enhancement to be located anywhere on the printed page.

Mechanical switches allow alerts to occur unnecessarily in the dark, in which an observer would not be able to read the printed material. This causes a drain on the battery which provides no benefit for enhancing the printed material. Thus, what is needed is a switch that requires ambient light as does the reading of the printed material.

Stamped metal switches are also used for activating alerting circuits found in magazines. Again, the switch has to be located near the backbone of the magazine to be activated. Alerting devices of this type cause production rate problems and do not survive the printing and binding equipment used in manufacturing. The switches are crushed as they proceed through the equipment and thus do not function properly in the completed magazine. If the electronic alerting device is connected to the switch via wires, as before, so as to position the enhancement in a desirable location, two separate components have to be attached in the magazine as opposed to one unit. One single unit would be much simpler to construct and insert into the magazine, and thus desirable.

A stamped metal switch similar to the one described above is cited in U.S. Pat. No. 4,363,081 issued Dec. 7, 1982 to Robert W. Wilbur. This switch has metal fingers attached to a flexible insulating strip which is moved as a greeting card is opened and closed. The metal fingers electrically connect contacts in the greeting card to activate electronic circuitry. The flexible insulating strip may be cut from the card or provided separately. In one embodiment, the strip has to be threaded into a slit cut into the card. This switch again depends on a certain location to activate properly. This switch requires several special folds and cuts in the greeting card to provide a mechanical structure which will ensure activation. Therefore, what is needed is a switch without moving parts thereby reducing the need for cutting, folding, threading, and gluing.

An additional switch for greeting cards is included in an electrical circuit package. U.S. Pat. No. 4,611,262 issued Sep. 9, 1986 to Michael D. Galloway, William H. Rose, and David T. Shaffer, discloses a stamped metal lead frame which supports electrical components, makes electrical connections, and provides an electrical switching function. The lead frame includes an insulating material molded onto the stamped metal which functions as a component support mechanism and partially determines the electrical circuit path. This lead frame would be expensive to tool and would support only the particular circuit function as designed. That is, if the circuit was to be modified, a new tool would have to be created in order to stamp the new lead frame. A new tool would also have to be made for the dielectric material. Mechanical tooling is an expensive part of the stamping method. What is needed, is a switch able to work with any circuit design and not dependent on mechanical tooling costs.

Additional mechanical switches are known. U.S. Pat. Nos. 4,726,771 issued Feb. 23, 1988 and 4,939,326 issued Jul. 3, 1990 to L. S. Weinblatt, disclose a complicated mechanical switch which can be used in a magazine for activation of a transmitter to survey readership of periodicals. This switch has several costly mechanical parts that would be damaged by binding or printing equipment. This switch activates whenever the magazine is open and would therefore not be useful if activation is desired only while the reader is viewing a particular page of the magazine. This switch would operate inconsistently in periodicals of various thickness. Thicker magazines would tend to keep the switch from making contact, whereas thinner magazines may not guarantee the switch turns off the circuit when the magazine is closed. The sensitivity of the switch would depend on the stiffness of the spring mechanism and would thus have to be re-tooled for various periodicals. Thus, what is needed is a switch with fewer parts, that will operate properly independent of the thickness of periodical without retooling a mechanical spring member. Also needed is a switch able to activate only in the location where audio visual enhancement is desired.

When multiple activations of an electronic alerting device are desirable, the mechanical interconnection of the above switches get complicated, especially if activations are to occur on different pages of a publication. Only one reference, Wilbur, suggests the possibility of multiple activations of an insert. All activations will only occur, however, in one printed location of the periodical. Therefore, what is needed is a switch that will easily activate various functions of an alerting device in various printed locations of the periodical.

Unbound periodicals, such as spiral binders, would not allow an alerting device to be used since a mechanical interconnection is typically needed to some other page of the publication. The only switch which may operate properly would be the switch included in the stamped metal lead frame submitted by Michael D. Galloway, William H. Rose, and David T. Shaffer. This switch has many problems, however, as mentioned above. Thus, what is needed is a switch that may be used in unbound periodicals.

OBJECTS AND ADVANTAGES

Accordingly, several objects and advantages of my invention include:

an inexpensive switch for use in magazines, books, greeting cards, and other published material;

- a switch which will activate electronic circuitry for audio, visual, and mechanical vibration enhancement;
- a switch able to withstand the pressures and bending associated with publishing and binding processes;
- a non-mechanical switch;
- a switch which will provide a single unit alerting device to be placed into published material;
- a switch which can be included on a printed circuit board;
- the ability to eliminate soldered wires interconnecting the switch to the electronic alerting device it is to activate;
- a way to eliminate the physical limitations of stamped metal switching members;
- a switch which does not require a mechanical interconnection to another page in the periodical;
- a switch which will allow audio visual enhancement to be located anywhere on a printed page;
- a switch for use in magazines, books and greeting cards which has no moving parts;
- a switch which will reduce steps in the publishing process such as folding, cutting, threading and gluing of printed material incorporating an alerting device;
- a way to eliminate the tooling costs for stamped metal switching members;
- a switch which will work with any circuit design;
- a switch with fewer parts;
- a switch which will activate independent of periodical thickness;
- a switch in which the activation sensitivity is easily adjustable and would not require retooling of a mechanical spring member;
- a switch which can be activated on a certain page of a periodical;
- a switch which will provide multiple activations of various circuit functions or alerts; and,
- a switch which will operate in unbound periodicals.

Additional objects of my invention are to provide an alerting device which will detect the presence of ambient light and generate an alert in response to the ambient light. Since ambient light is needed to read printed information, it is desirable to provide an alert when the information is readable. The ambient light is blocked by other pages or the cover of the periodical as is the printed information which contains the alerting device.

A further object of my invention is to provide an alerting device with visual enhancement which cooperates with the printed information to improve communication of that information.

A still further object of the invention is to provide an alerting device with audio enhancement which cooperates with the printed information to improve communication of that information.

A further object is to provide an alerting device with mechanical vibration which cooperates with the printed information to improve communication of that information.

Yet another object of my invention is to provide an alerting device with audio, visual, and/or mechanical vibration enhancement which cooperates with the printed information to improve communication of that information.

Still other objects of my invention are to provide an alerting device which will provide multiple alerts in response to various positions of certain pages contained in a periodical. The multiple alerts could be unique or may be reactivations of the first alert. Unique activations could be used to tell various parts of a story or play different movements of music at various locations in the periodical to enhance the printed material where a particular activation occurs. Multiple photosensors along with multiple light blocking pages are used to cause activations of the alerting device in various locations in the periodical.

Further objects of my invention are to provide various mechanisms for exposing photosensors to ambient light such as cutout holes or dark ink.

A further object of my invention is to provide protection to electrical components mounted on a printed circuit board with the use of a pigmented adhesive (e.g. a pigmented encapsulation material or the like) but allowing light to be visible from a light source mounted on the printed circuit board.

A still further object of my invention is to provide a method for binding an inflexible circuit board into a flexible periodical.

Further objects and advantages of my invention will become apparent from a consideration of the drawings and ensuing description of it.

List of Reference Numerals

Figure 1:
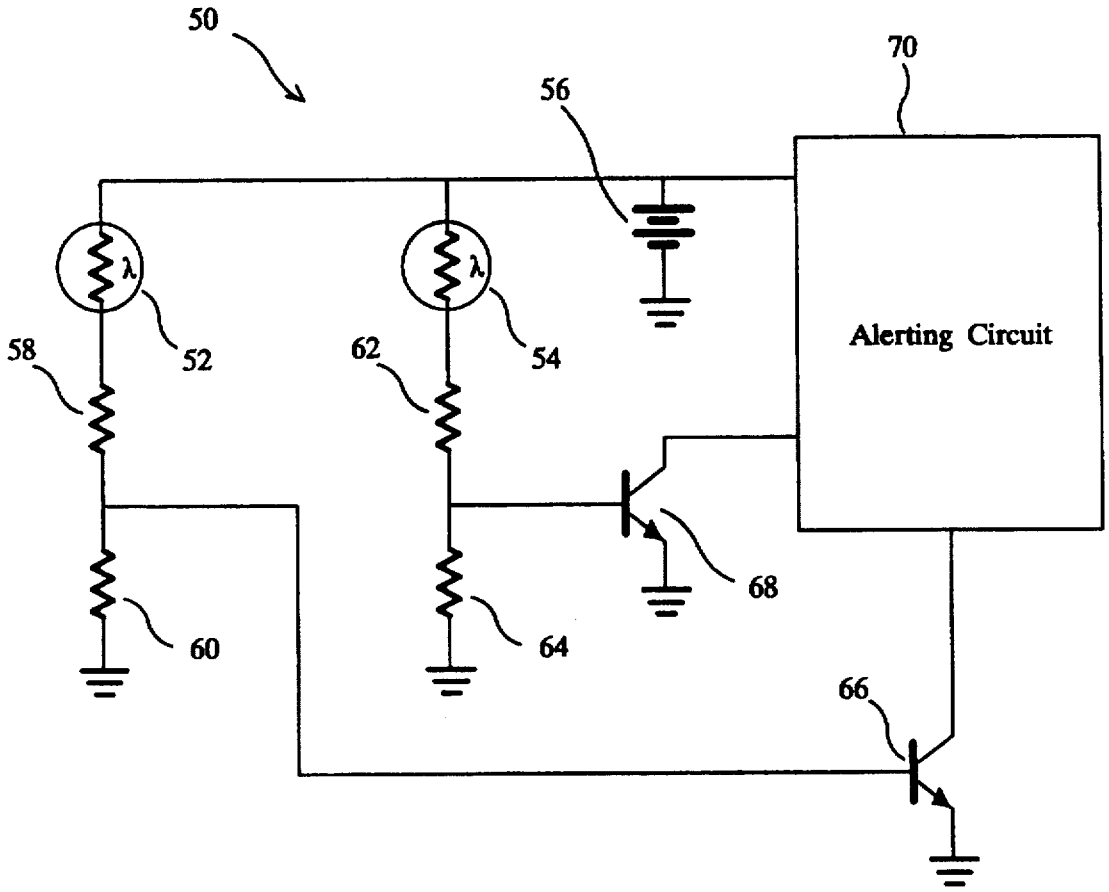
FIG. 1 is an example schematic of a light sensitive switch which may be used to activate an alerting circuit for audio, visual, and/or mechanical vibration enhancement purposes.

| | |
|---|---|
| 50 | Alerting Device |
| 52 | Photosensor 1 |
| 54 | Photosensor 2 |
| 56 | Battery |
| 58 | Resistor 1 |
| 60 | Resistor 2 |
| 62 | Resistor 3 |
| 64 | Resistor 4 |
| 66 | Transistor 1 |
| 68 | Transistor 2 |
| 70 | Alerting Circuit |
| 72 | Printed Circuit Board |
| 74 | Audio Transducer |
| 76 | Lamp |
| 78 | Magazine |
| 80 | Magazine Cover |
| 82 | Magazine Pages |
| 84 | Magazine Backbone |
| 86 | Activation Page |
| 88 | Light Blocking Page 1 |
| 90 | Photosensor 1 Cutout Hole |
| 92 | Lamp Cutout Hole |
| 94 | Book |
| 96 | Book Front Cover |
| 98 | Book Pages |
| 100 | Book Backbone |
| 102 | Book Back Cover |
| 104 | Photosensor 2 Cutout Hole |
| 106 | Light Blocking Page 2 |
| 108 | Ink Blot |
| 110 | Greeting Card |
| 112 | Outer Front Cover Section |
| 114 | Inner Front Cover Section |
| 116 | Outer Back Cover Section |
| 118 | Inner Greeting Section |
| 120 | Card Backbone |
| 122 | Fold |
| 124 | Pigmented Adhesive |
| 126 | Adhesive Opening |
| 128 | Motor |
| 130 | Motor Shaft |
| 132 | Propeller |
| 134 | Motor Shaft Cutout Hole |
| 136 | Solenoid |
| 138 | Solenoid Return Spring |
| 140 | Solenoid Shaft |
| 142 | Drive Connection Pin |

-continued

| List of Reference Numerals | |
|---|---|
| 144 | Lever |
| 146 | Lever Slot |
| 148 | Lever Pivot Pin |
| 150 | Hand |
| 152 | Motor Cam |
| 154 | Cam Pin |
| 156 | Cam Lever |
| 158 | Titanium Nickel Alloy Wire |
| 160 | PCB Rivet 1 |
| 162 | PCB Rivet 2 |
| 164 | Lever Rivet |
| 166 | Lever Interconnect Wire |
| 168 | Titanium Nickel Alloy Wire Return Spring |
| 170 | PCB Return Spring Hole |
| 172 | Lever Return Spring Hole |
| 174 | Activation Page Cutout Slot |
| 176 | Rotating Mass |
| 178 | Magazine Signature |
| 180 | Main Packing Drum |
| 182 | Signature Gripper |
| 184 | Drum Axis |

DESCRIPTION OF INVENTION

An electronic insert or alerting device consists of a battery, a switching mechanism, and an alerting circuit which may include an audio, visual and/or mechanical vibrator to enhance the printed material. The switching mechanism supplies battery power to the alerting circuit upon triggering.

A first embodiment of the present invention is illustrated in FIG. 1, which shows an example of an electrical schematic of an alerting device 50 with two light sensitive switches. One switch is all that is needed if one activation of the alert is desired. An optional second switch is also shown. The positive side of a battery 56 is connected to an alerting circuit 70 and to a photosensor 52 and a photosensor 54. Alerting circuit 70 could consist of various types of audio, visual, and/or mechanical vibration enhancement such as a tone generator, flashing LED or rotating mass. Circuits such as tone generators and light flashers are well known. Photosensor 52 and photosensor 54 in this schematic diagram are preferably CdS cells (light sensitive resistors). The alerting device 50 could employ other types of photosensors such as solar cells or phototransistors. By supplying a voltage when exposed to light, a solar cell could thus be used to replace both battery 56 and the switch if cost and durability are not important and only one activation is needed. A phototransistor works similarly to a regular transistor except instead of controlling a voltage or current with an input voltage or current, control is achieved with light intensity. Phototransistors are however, usually relatively expensive and have a taller profile. A CdS cell (light sensitive resistor) such as photosensor 52, as shown in FIG. 1, is therefore the preferred sensor due to cost and durability considerations. Photosensor 52 is then connected to a resistor 58 and a resistor 60 which form a voltage divider for a switching transistor 66. Switching transistor 66 is connected to alerting circuit 70 so as to connect the negative terminal of battery 56 to alerting circuit 70 when activated. The activation sensitivity may be adjusted by selecting the values of resistor 58 and resistor 60. The sensitivity may also be adjusted by the type of photosensor 52 which is used in the circuit. The switch may be made very sensitive to light such that light being transmitted through a page or several pages would be enough to activate alerting circuit 70. Conversely, the switch could be made such that a very bright light is needed to activate alerting circuit 70. Transistor 66 could be replaced by two transistors in a "darlington pair" topology. This transistor arrangement is well known and would enable the light sensitive switch to provide a higher drive current to alerting circuit 70.

If alerting circuit 70 is capable of multiple alerts that may or may not be unique, an optional second switch could be added as shown in FIG. 1. The positive side of battery 56 is connected to photosensor 54. Photosensor 54 is then connected to a resistor 62 and a resistor 64 which form a voltage divider for a switching transistor 68. Switching transistor 68 is connected to alerting circuit 70 so as to connect the negative terminal of battery 56 to alerting circuit 70 when activated. Any number of photosensors could be added to give any number of activations to alerting circuit 70. The sensitivity could also be adjusted on the second switch by the same methods used to adjust the sensitivity of the first switch and the sensitivity could be different for both switches. If alerting circuit 70 contains an integrated circuit, transistor 66, transistor 68, resistor 58, resistor 60, resistor 62, and resistor 64 could all be integrated, thus eliminating additional components. Any level of integration of alerting circuit 70 could be accomplished. For example, transistor 66 and transistor 68 could be integrated and resistor 58, resistor 60, resistor 62, and resistor 64 could be discrete in order to maintain the flexibility of adjusting the activation sensitivity. Battery 56 should be as flat as possible. Coin cells such as watch or calculator batteries work well for circuits which do not require a large amount of current. Other batteries such as paper lithium provide an extremely flat profile and are becoming more available. Alerting devices which need a large drive current or require a long lifetime may require the use of a flat battery such as those used in film packs. An example of such a battery would be the POLAPULSE P-100 manufactured by Polaroid Corporation, Cambridge, Mass.

Figure 2:
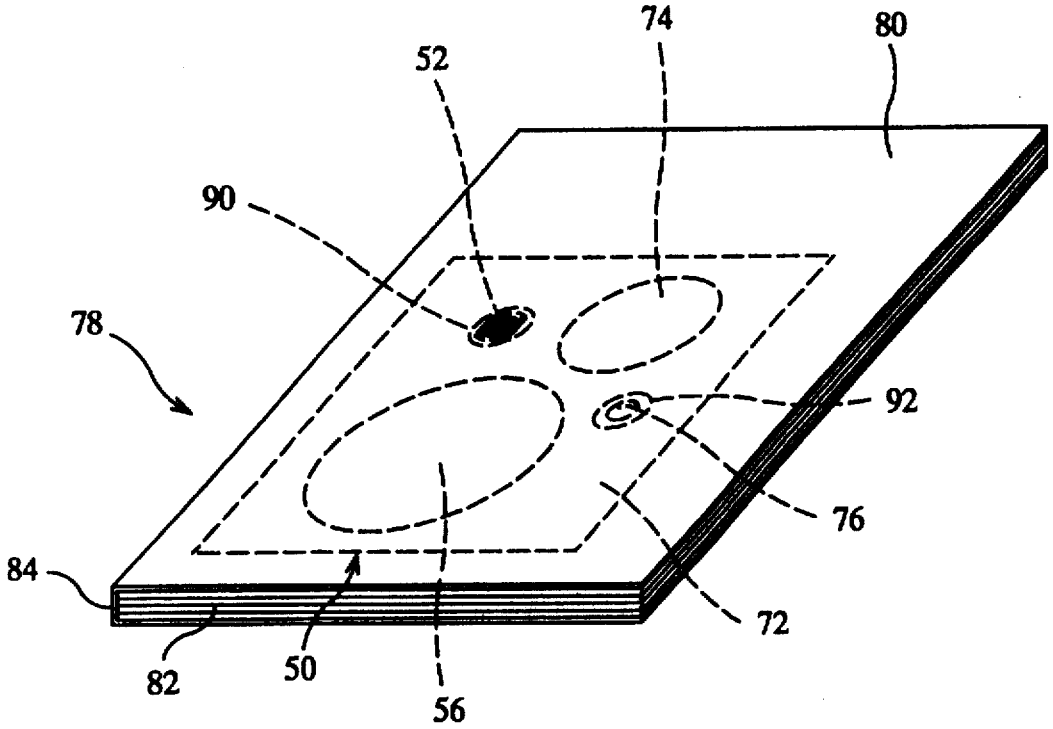
FIG. 2 is a perspective view of a closed periodical containing an alerting device which would not be activated.
Figure 3:
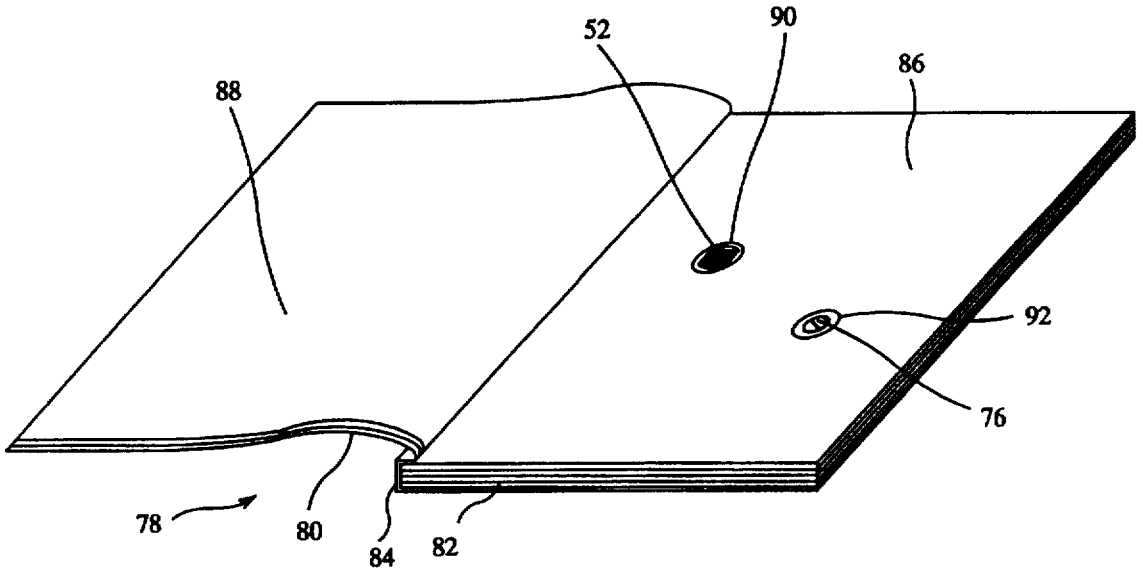
FIG. 3 is a perspective view of a periodical in the opened position in which an alerting device is activated upon exposure to ambient light.
Figure 4:
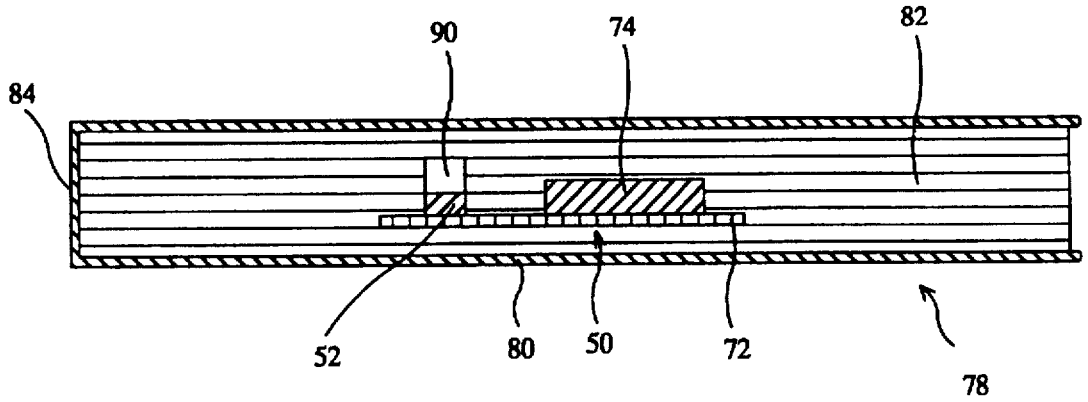
FIG. 4 is a cross-sectional view of a closed periodical containing an alerting device which would not be activated.
Figure 5:
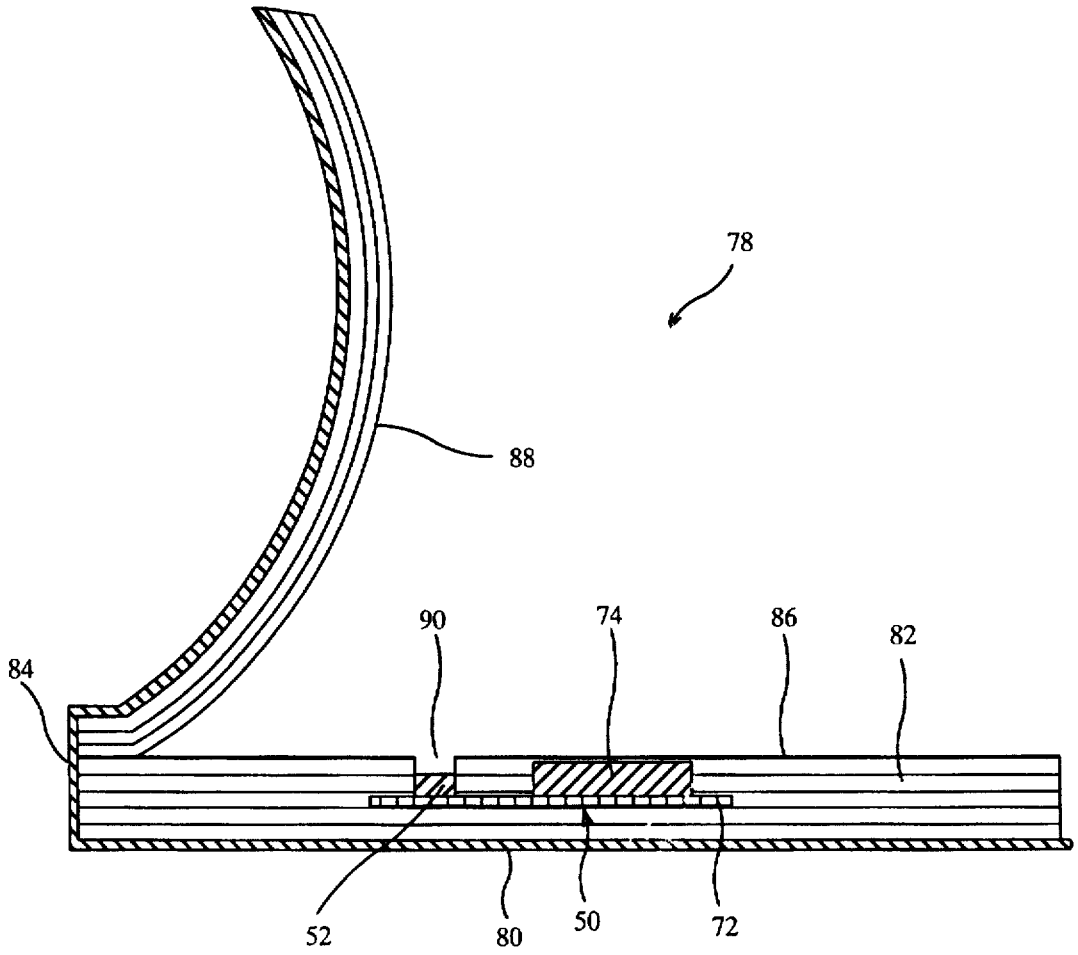
FIG. 5 is a cross-sectional view of a periodical in the opened position in which an alerting device is activated upon exposure to ambient light.

Insertion of alerting device 50 into periodicals is shown in FIGS. 2 through 19. FIGS. 2, 3, 4, and 5 show a magazine 78 containing alerting device 50. FIG. 2 and FIG. 4 show magazine 78 in a closed position and FIG. 3 and FIG. 5 show magazine 78 in an opened position. FIG. 2 and FIG. 3 are perspective views of magazine 78 whereas FIG. 4 and FIG. 5 are cross-sectional views of magazine 78. Magazine 78 consists of magazine pages 82 bound together on one side at a magazine backbone 84. Pages 82 are then wrapped by a magazine cover 80 which is folded and attached at backbone 84. This type of binding is known as a squareback process. A saddlewire type of binding produces a similar periodical with the pages or signatures stapled at backbone 84. Alerting device 50 in this example, consists of a printed circuit board 72, battery 56, photosensor 52, an audio transducer 74, and a lamp 76. Example alerting device 50 would thus contain both audio and visual enhancement. Alerting device 50 is not necessarily shown to scale and individual components such as resistors and transistors are not included in FIGS. 2 through 19 for clarity. The actual size of device 50 is typically smaller and will depend on the electrical components used for alerting circuit 70 and the size of battery 56. Printed circuit board 72 serves two functions. First, it interconnects all of the electrical components to form an electrical circuit. Second, it provides support to all the components which make up alerting device 50. Photosensor 52, audio transducer 74, and lamp 76 are soldered directly to printed circuit board 72. Battery 56 can be attached to board 72 by either solder or spring clips which make electrical connection. Other electrical components which may be used in the electrical circuit are also soldered to board 72. With this type of construction, alerting device 50 is a single unit which may be positioned in any desirable location on a printed activation page 86 as shown in FIG. 3. A photosensor cutout hole 90 is provided in activation page 86 which is directly covering board 72. Photosensor 52 is aligned with photosensor hole 90 so as to expose it to ambient light when magazine 78 is opened to activation page 86 where triggering is to occur. A lamp cutout hole 92 is also provided for lamp 76 so the viewer will be able to see visual enhancement. Lamp hole 92 is also aligned with lamp 76. Alerting device 50 could be attached to activation page 86 in a variety of ways. One such way would simply be to adhesively attach board 72 to the back of activation page 86. Alerting device 50 could also be sandwiched between activation page 86 and the page which directly follows it. These two pages could be glued together to form a single page in magazine 78. FIG. 2 and FIG. 4 show magazine 78 in the closed position. Since ambient light is not allowed to reach photosensor 52, activation of device 50 is not possible. FIG. 3 and FIG. 5 show magazine 78 in the opened position where alerting device 50 is activated. A light blocking page 88 is shown in such a position that it will not block ambient light from photosensor 52 so as to activate electronic alerting device 50. A cutout hole could also be put into blocking page 88 and pages previous to blocking page 88 and aligned with photosensor hole 90 such that activation would occur before the reader reaches the point where the visual enhancement is to be viewed on activation page 86. This could activate transducer 74 early, thus causing the reader to go to the location where the visual enhancement, lamp 76, is located. Lamp hole 92 could also be extended through several pages prior to activation page 86 if the visual alert is desired before the reader arrives at the actual location of alerting device 50. Photosensor hole 90 could also be eliminated if the light sensitive switch is made very sensitive such that it is activated by ambient light transmitted through translucent activation page 86.

Figure 6:
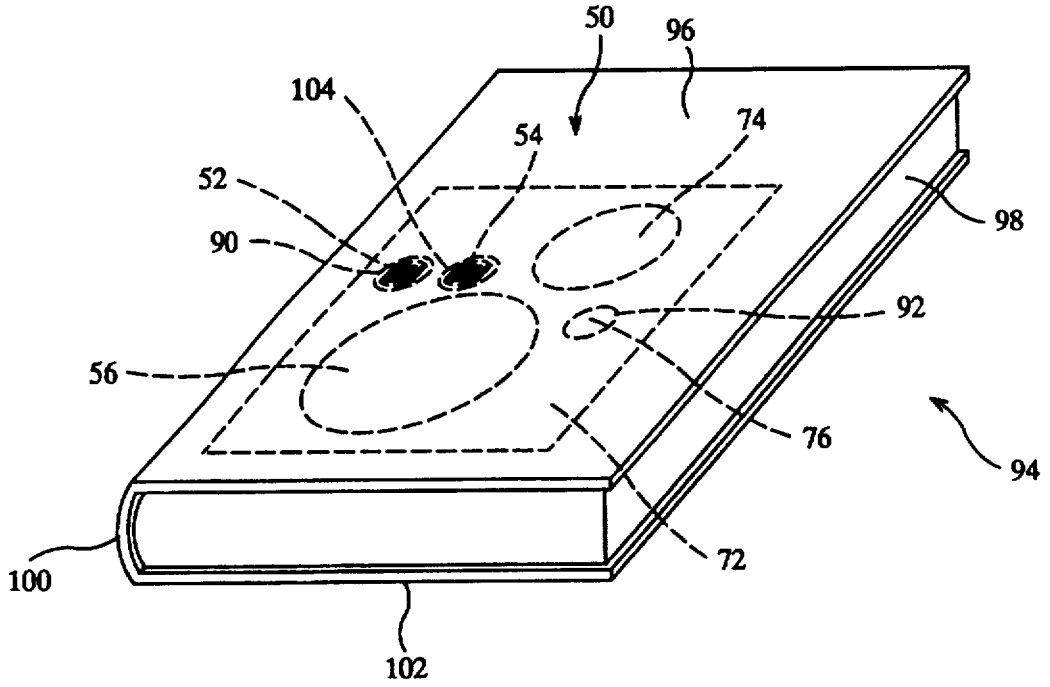
FIG. 6 is a perspective view of a closed publication containing an alerting device which would not be activated.
Figure 7:
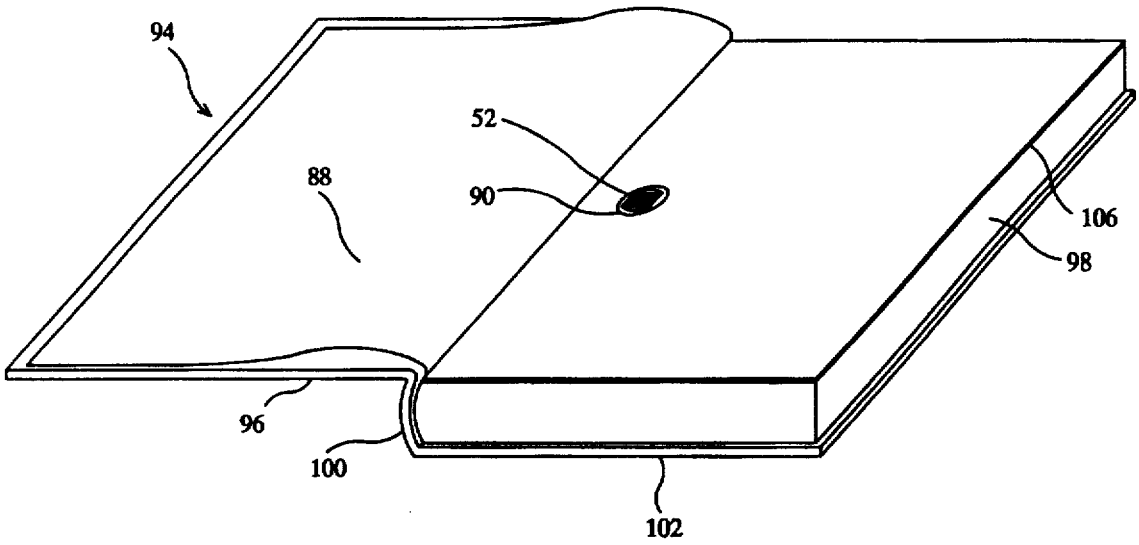
FIG. 7 is a perspective view of an opened publication containing an alerting device with two sensors which provide multiple activations of the alert. The first sensor is exposed to light only through a cutout hole, which provides the first activation.
Figure 8:
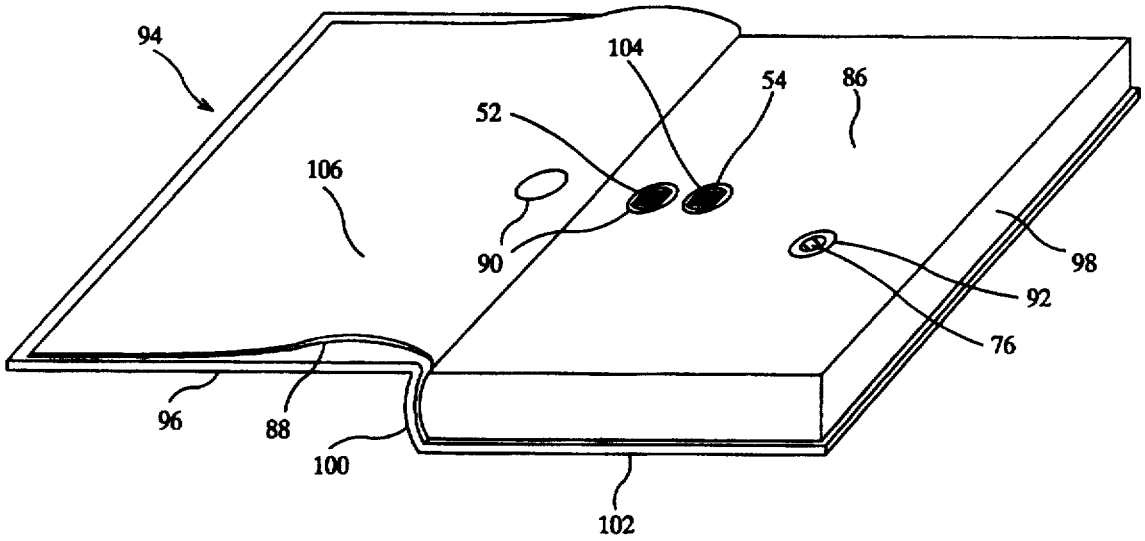
FIG. 8 is a perspective view of an opened publication exposing two sensors through two cutout holes for a second activation of an alerting device.
Figure 9:
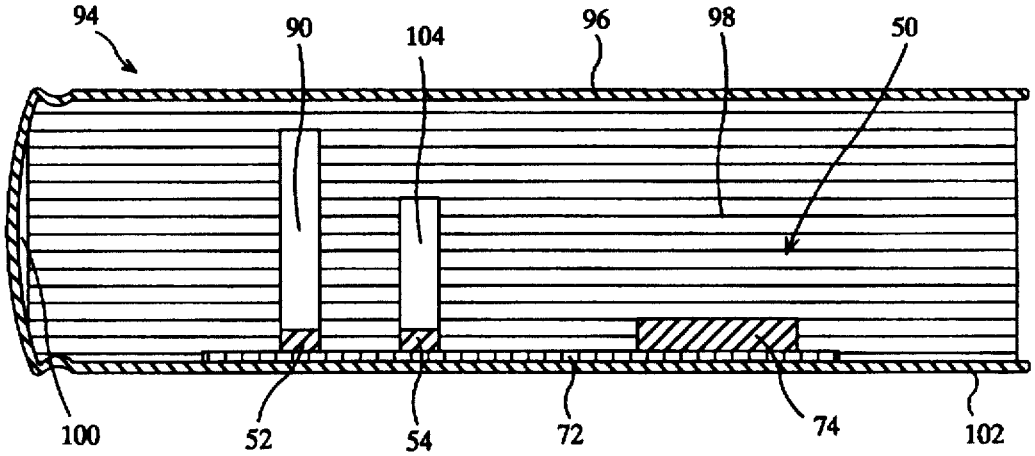
FIG. 9 is a cross-sectional view of a closed publication containing an alerting device with two sensors, which provide multiple activations of the alert, which would not be activated.
Figure 10:
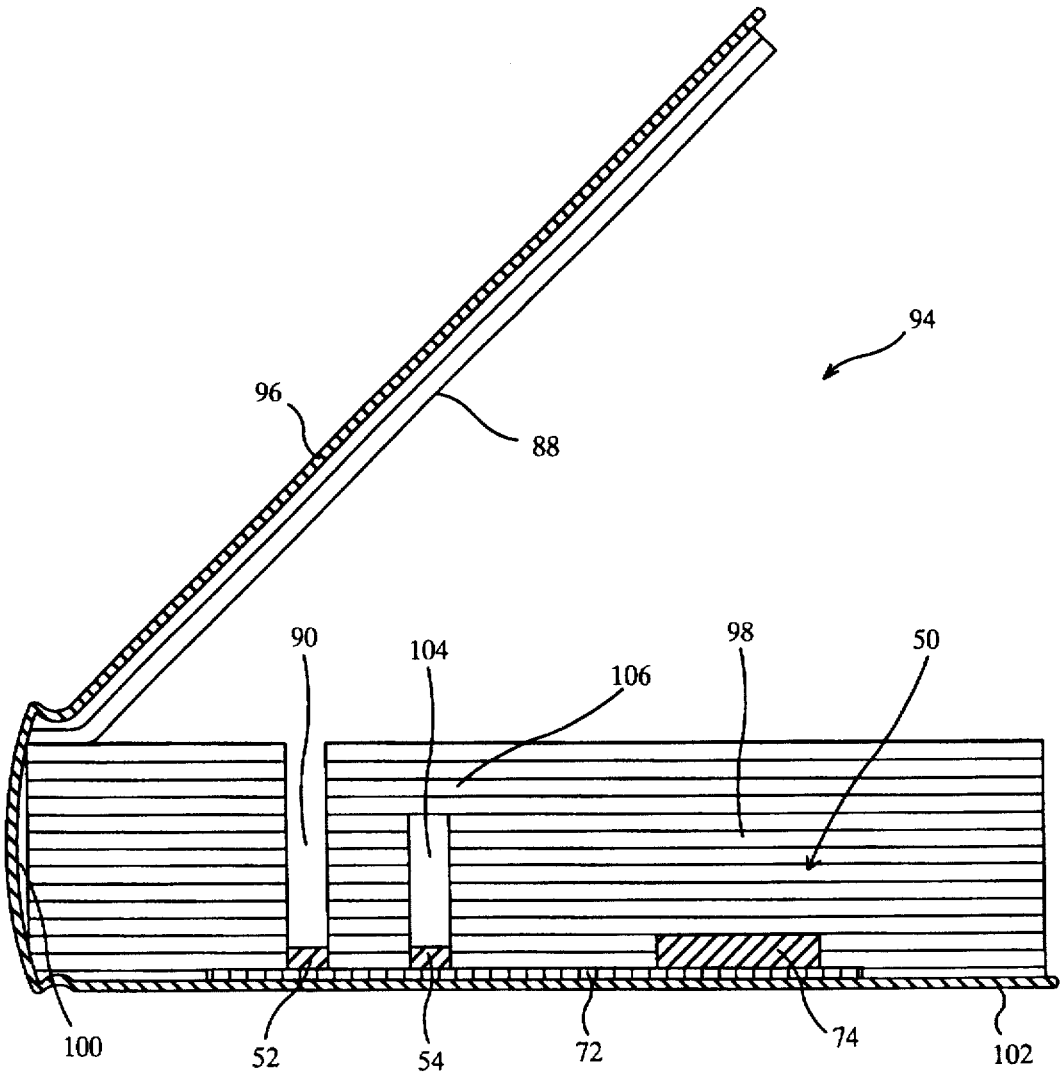
FIG. 10 is a cross-sectional view of an opened publication with two sensors which provide multiple activations of an alerting device. The first sensor is exposed to light only through a cutout hole, which provides the first activation.
Figure 11:
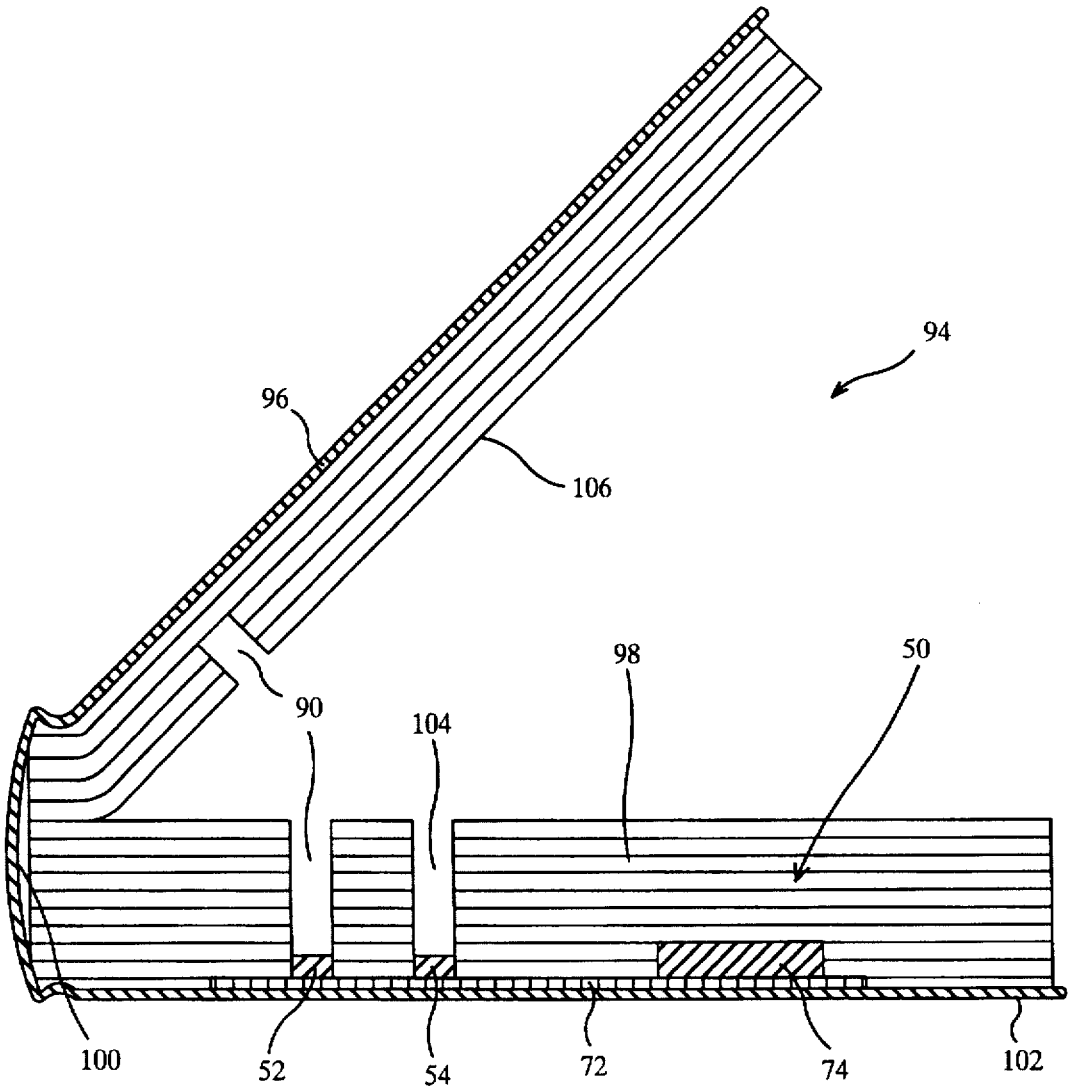
FIG. 11 is a cross-sectional view of an opened publication exposing two sensors for a second activation of an alerting device.
Figure 12:
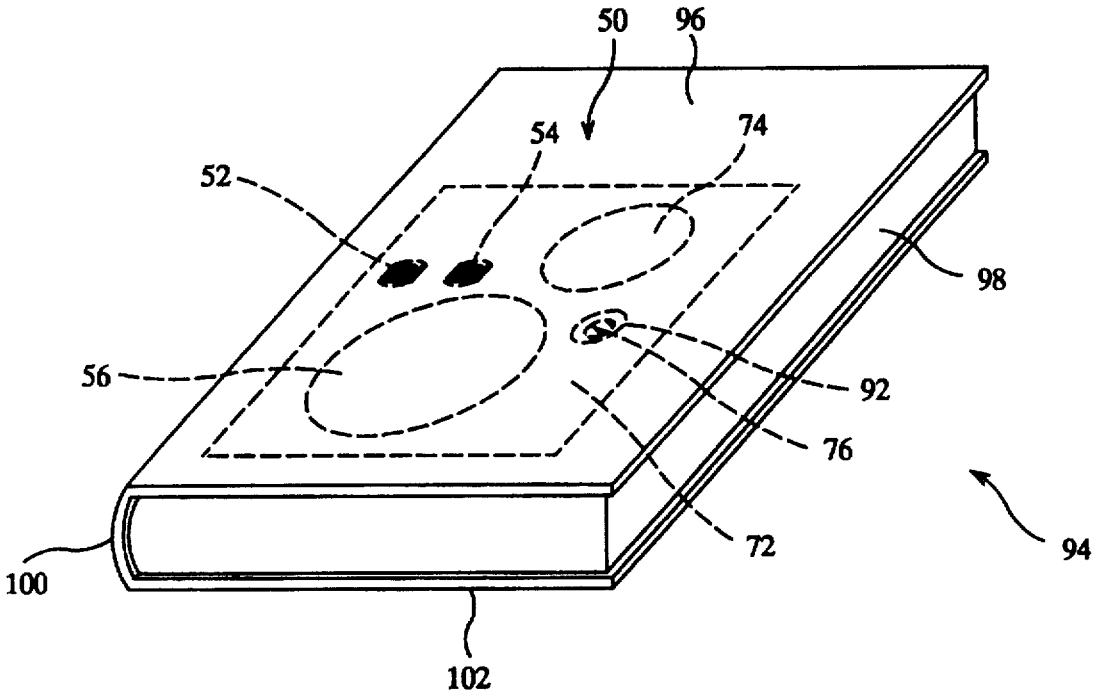
FIG. 12 is a perspective view of a closed publication containing an alerting device which would not be activated.
Figure 13:
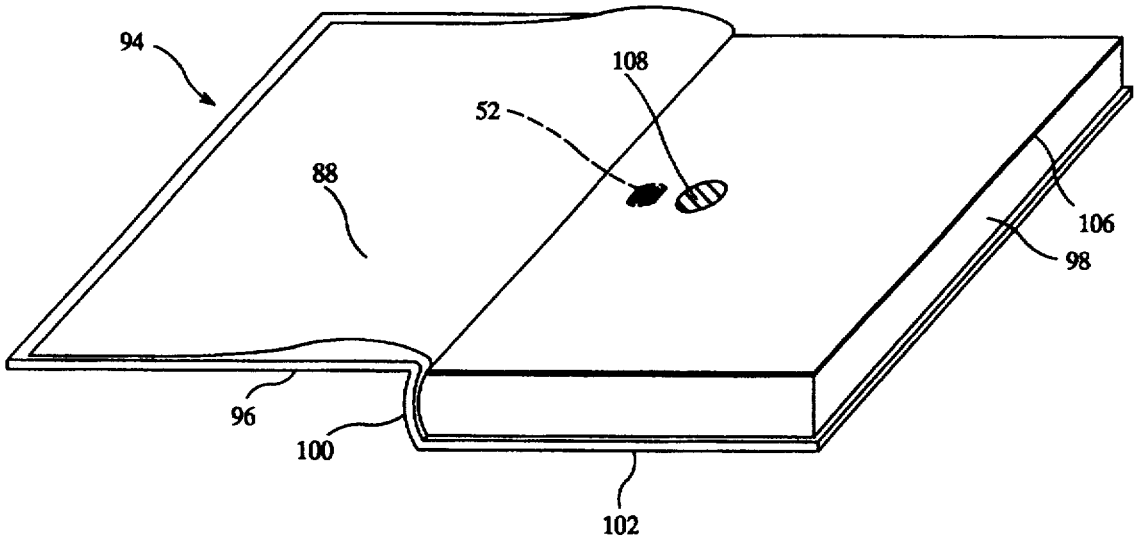
FIG. 13 is a perspective view of an opened publication with two sensors which provide multiple activations of an alerting device. The first sensor only is exposed to light transmitted through a page. The second sensor is covered by a dark ink on a blocking page to inhibit the second activation.
Figure 14:
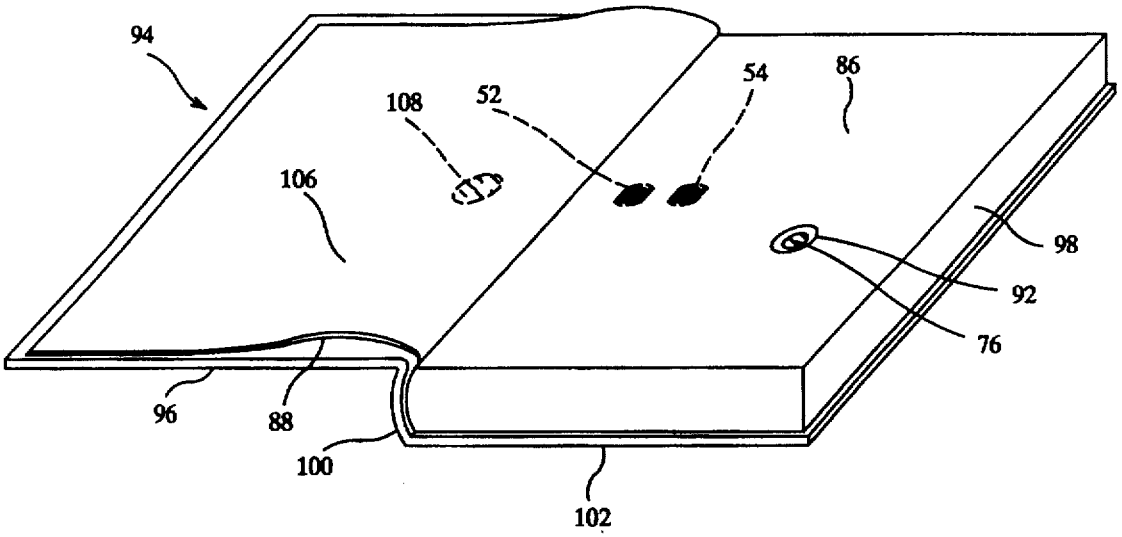
FIG. 14 is a perspective view of an opened publication containing an alerting device exposing two sensors to light transmitted through a page.

FIGS. 6 through 14 show a book 94 containing electronic alerting device 50. FIGS. 6, 9, and 12 show book 94 in a closed position. FIGS. 7, 10, and 13 show book 94 in an opened position in which the first of two activations of alerting device 50 would occur. FIGS. 8, 11, and 14 show book 94 in an opened position in which the second of two activations of device 50 would occur. FIGS. 6, 7, 8, 12, 13, and 14 are perspective views of book 94 whereas FIGS. 9, 10, and 11 are cross-sectional views. Book 94 consists of book pages 98 bound together on one side at a book backbone 100. Pages 98 are then wrapped by a cover which is attached at backbone 100, forming two sections, a book front cover 96 and a book back cover 102. Alerting device 50 consists of printed circuit board 72 which contains battery 56, audio transducer 74, lamp 76, photosensor 52 for the first activation, and photosensor 54 for a second activation. Light blocking page 88, as shown in FIG. 7 and FIG. 10 is used to block ambient light from photosensor 52 and photosensor 54. In FIGS. 7 and 10 photosensor hole 90 is provided in light blocking page 106 and aligned with photosensor 52. Photosensor hole 90 is put into light blocking page 106 where the first activation is to occur and extends through any number of pages until it reaches activation page 86 where alerting device 50 is located. FIG. 7 depicts light blocking page 106 to consist of only one page, whereas FIG. 10 depicts light blocking page 106 to consist of several pages. Light blocking page 106 serves two functions. First, it provides a photosensor cutout hole 90 to expose photosensor 52 to ambient light. Second, it blocks ambient light from photosensor 54. A second photosensor cutout hole 104 is provided and aligned with photosensor 54 in activation page 86. FIG. 8 depicts activation page 86 to consist of a single page whereas FIG. 11 depicts activation page 86 to consist of several pages. Staggering the starting location of the cutout holes would allow various activations times. Audio could be used to tell various parts of a story in a talking book or provide a musical environment or sound effects for portions of a story. For example, thunder for a stormy night or car engine sounds and tire screeching for a car chase. Any number of activations could be incorporated into alerting device 50. This example would allow two parts of a story to be told or two movements of music or sound effects in book 94. Alerting device 50 could be located anywhere in book 94. For example, device 50 could be adhesively mounted to the back of activation page 86. Or device 50 could be sandwiched between activation page 86 and the following page thus forming one page in book 94. Alerting device 50 could also be attached to one of the covers such as back cover 102 of book 94 as depicted in FIGS. 9, 10, and 11. FIGS. 12, 13, and 14 show book 94 without photosensor cutout hole 90 and photosensor cutout hole 104 for photosensor 52 and photosensor 54. Ambient light is transmitted to photosensor 52 through light blocking page 106 and blocked from photosensor 54 with an ink blot 108 located on light blocking page 106. Inkblot 108 could be a picture with dark contrast in the area of photosensor 54. Photosensor 52 would be made more sensitive to light being transmitted through light blocking page 106 and activation page 86, whereas photosensor 54 would be made sensitive enough to respond to the light which would be transmitted through activation page 86 only. This arrangement would save a process step of cutting holes in some of the pages.

Figure 15:
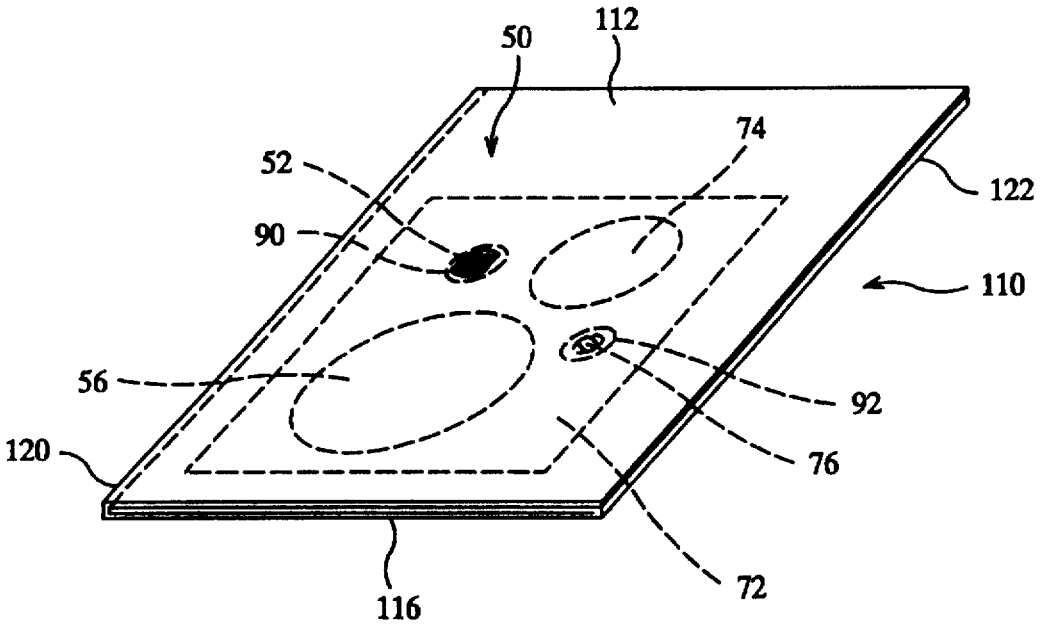
FIG. 15 is a perspective view of a greeting card containing an alerting device and consisting of two folds. In the closed position, the alert would not be activated.
Figure 16:
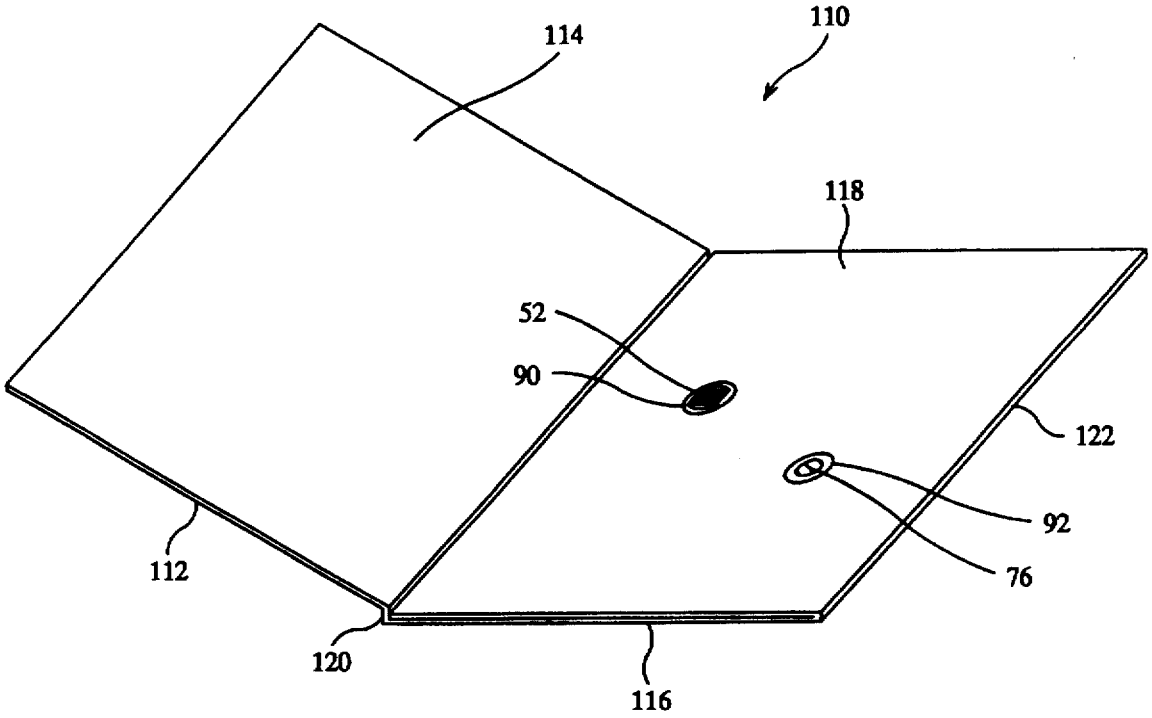
FIG. 16 is a perspective view of a greeting card in the opened position exposing a sensor to light, thus activating an alerting device.
Figure 17:
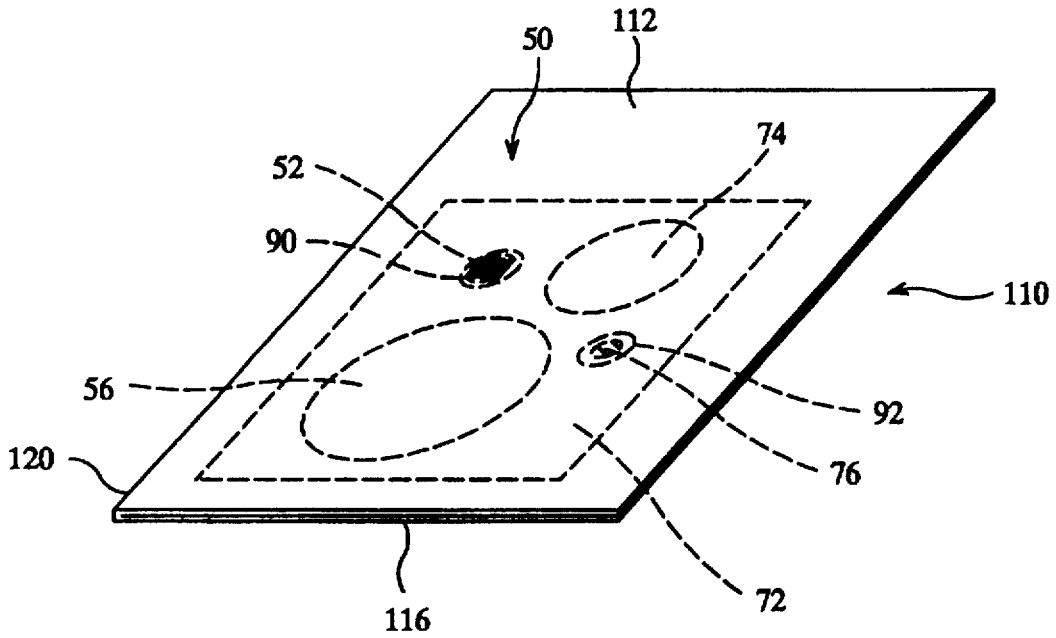
FIG. 17 is a perspective view of a simple greeting card consisting of one fold with an alerting device mounted on the back. In the closed position, the alert would not be activated.
Figure 18:
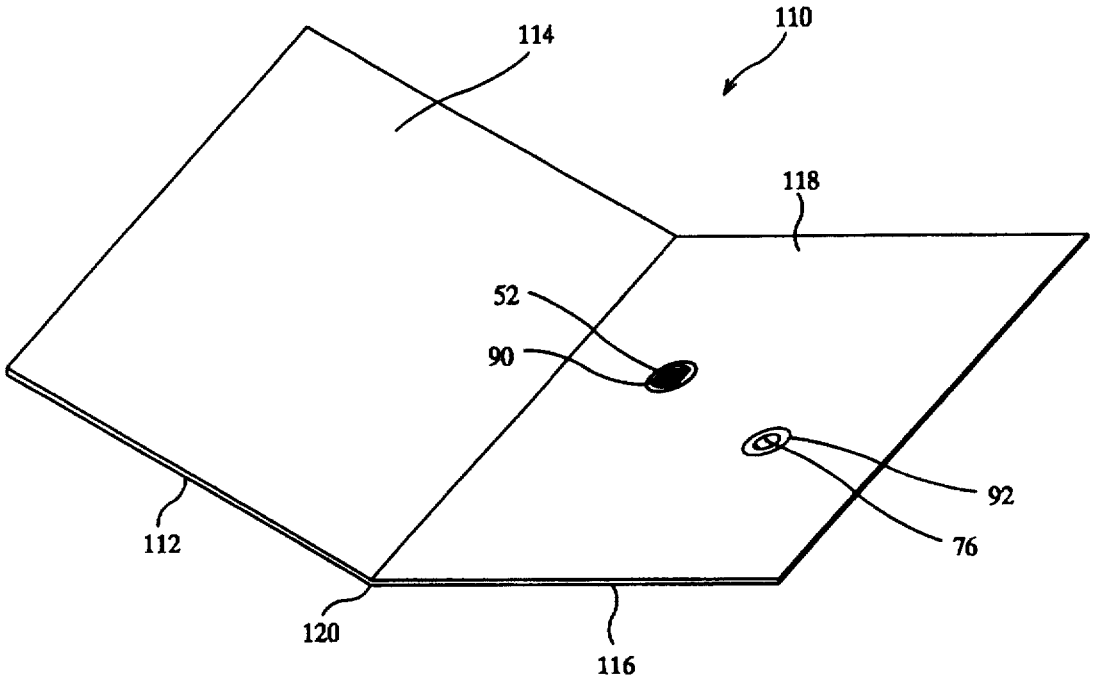
FIG. 18 is a perspective view of a simple greeting card in the opened position exposing a sensor to light, thus activating an alerting device.
Figure 19:
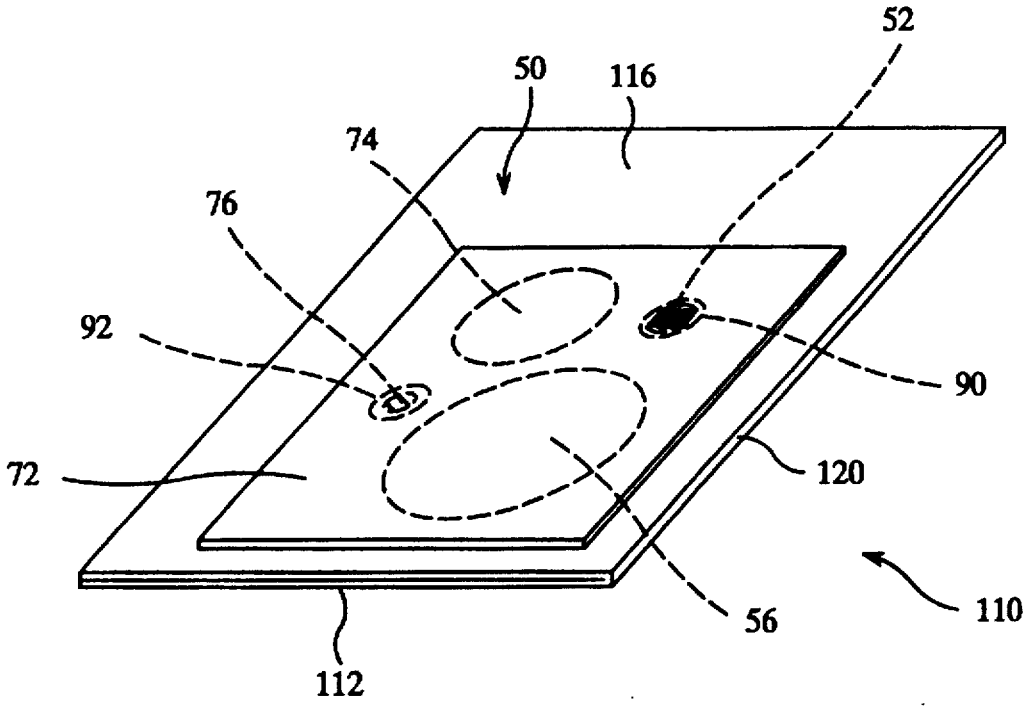
FIG. 19 is a perspective view of the back of a card where an alerting device has been adhesively mounted.

FIGS. 15, 16, and 17 show perspective views of a greeting card 110 containing electronic alerting device 50. FIG. 15 shows greeting card 110 in a closed position which would not activate device 50 since it is not exposed to ambient light. Card 110 is formed by folding sheet stock into three equal sections. The folds are performed first at a fold 122 then at a card backbone 120 which provides a hinge between an outer front cover section 112 and an outer back cover section 116. The folded sheet stock thus forms an outer front cover section 112, an inner front cover section 114, an inner greeting section 118, and an outer back cover section 116. Alerting device 50 is formed on printed circuit board 72 which contains battery 56, transducer 74, lamp 76, and photosensor 52. Alerting device 50 can be sandwiched between inner greeting section 118 and outer back cover section 116 as shown in FIG. 16. Photosensor cutout hole 90 is provided and aligned with photosensor 52 in inner greeting section 118. A simpler method of forming greeting card 110 is depicted in FIG. 17, 18, and 19. The sheet stock is folded into two equally sized sections at card backbone 120 which again hinges outer front cover section 112 and outer back cover section 116. Alerting device 50 could then be adhesively mounted with glue or tape to back cover section 116 so as to allow lamp 76 to show through lamp cutout 92 in inner greeting section 118 as shown in FIGS. 18 and 19. Photosensor 52 would also be aligned with photosensor cutout hole 90 which goes from outer back cover section 116 to inner greeting section 118. This approach would eliminate fold 122 in the forming of greeting card 110 as shown in FIGS. 15 and 16. This approach would also save sheet stock material.

Figure 20:
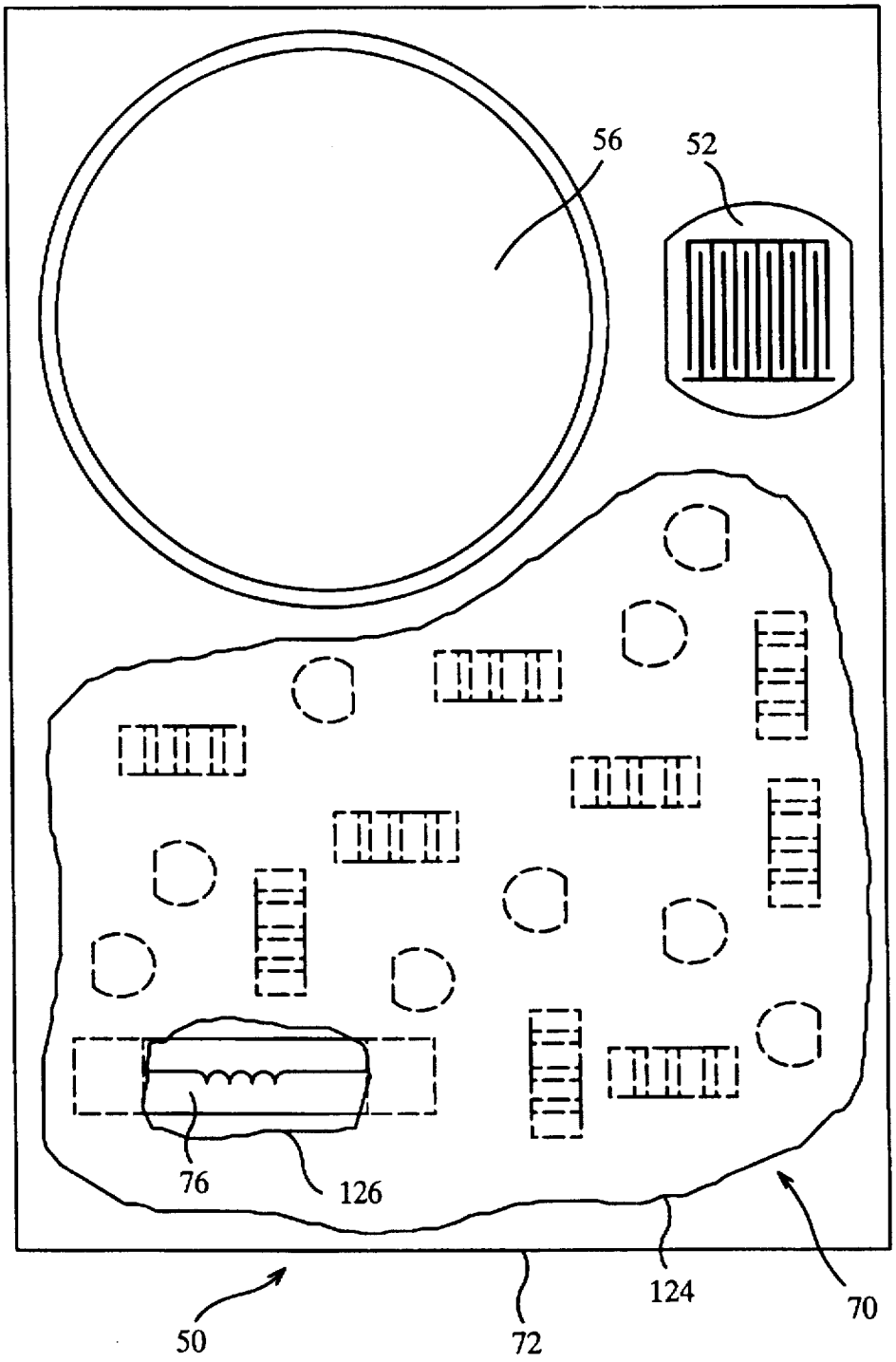
FIG. 20 is a top view of an alerting device printed circuit board containing components and a lamp with a pigmented adhesive encapsulating various components.
Figure 21:
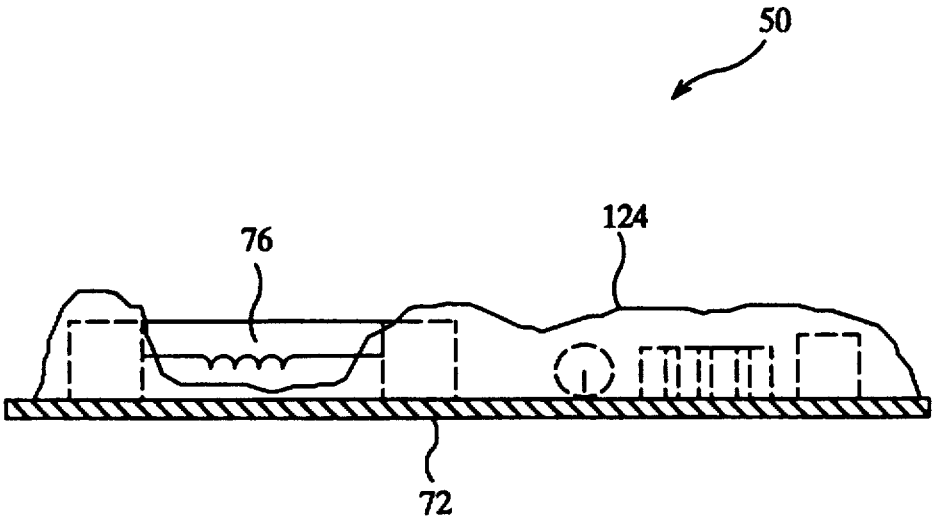
FIG. 21 is a side view of an alerting device printed circuit board with components, a lamp and pigmented adhesive encapsulating various components.

FIGS. 20 and 21 show alerting device 50 with a pigmented adhesive 124 (e.g., a pigmented encapsulation material or the like) securing electrical components to printed circuit board 72. An opening 126 is provided in pigmented adhesive 124 to allow light from lamp 76 to be visible to the viewer. Pigmented adhesive 124 serves two functions for device 50. First, it helps secure electrical components to printed circuit board 72. Second, it decreases feedback from lamp 76 to photosensor 52. In an alternate embodiment the pigmented adhesive could be eliminated. Careful layout of alerting device 50 on printed circuit board 72 and the use of surface mountable components reduces the need for adhesive 124.

Figure 22:
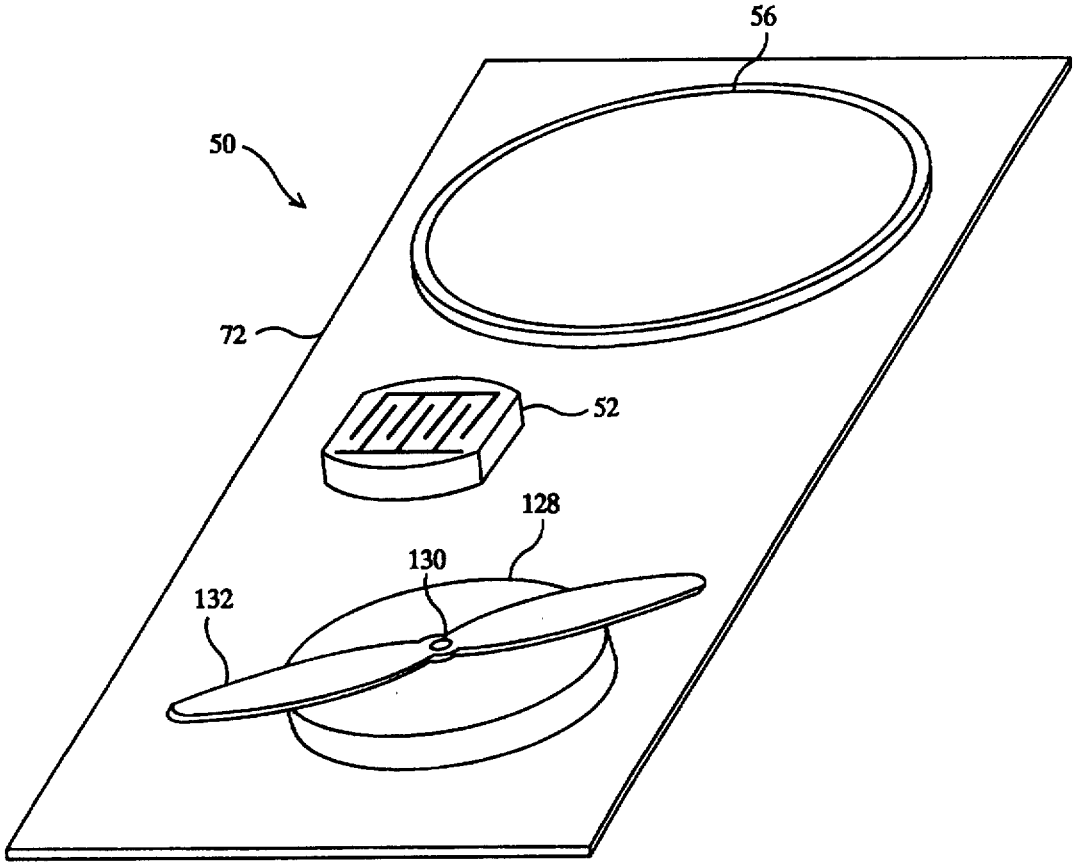
FIG. 22 is a perspective view of an alerting device containing a motor which will rotate an object in order to provide visual enhancement.
Figure 23:
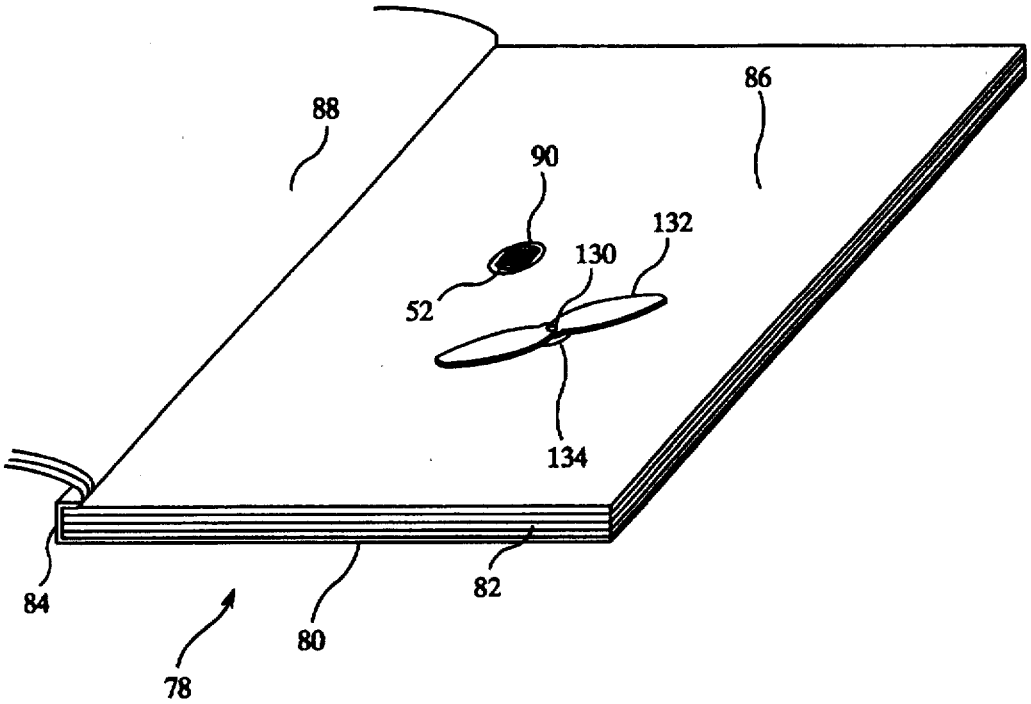
FIG. 23 is a perspective view of a periodical in the opened position in which an alerting device with a motor is activated upon exposure to ambient light. The alerting device provides visual enhancement to the printed material.

FIG. 22 depicts alerting device 50 with an electric motor 128 which is used to spin a moving icon. For example, propeller 132 connected to a motor shaft 130 rotates when photosensor 52 is exposed to light. Motors such as those found in electronic watches and pagers are suitable for use as electric motor 128. Motor 128 could be mounted to printed circuit board 72 with spring clips which could also make electrical connection. Propeller 132 could be made from numerous materials such as plastic or cardboard and attached to motor shaft 130 in a variety of ways such as pressure fit or adhesive. FIG. 23 illustrates alerting device 50 with motor 128 and propeller 132 inserted into magazine 78. A motor shaft cutout hole 134 has been provided in activation page 86. Alerting device 50 could be installed into magazine 78 first by aligning shaft 130 with hole 134 and photosensor 52 with hole 90 after which the attachment of propeller 132 to shaft 130. Propeller 132 could be replaced by many other objects such as a wheel of a car or an arrow pointing to various items on activation page 86. Alerting device 50 and its parts are not shown to scale and individual components such as resistors and transistors are not included in FIG. 22 for clarity. The actual size of device 50 is typically smaller and will depend on the electrical components used for alerting circuit 70 as depicted in FIG. 1. Motor 128 is considered to be an example subset of alerting circuit 70 as previously defined in FIG. 1. With the addition of timing circuitry to alerting circuit 70, motor 128 could be turned on and off intermittently as long as photosensor 52 is exposed to light.

Figure 24:
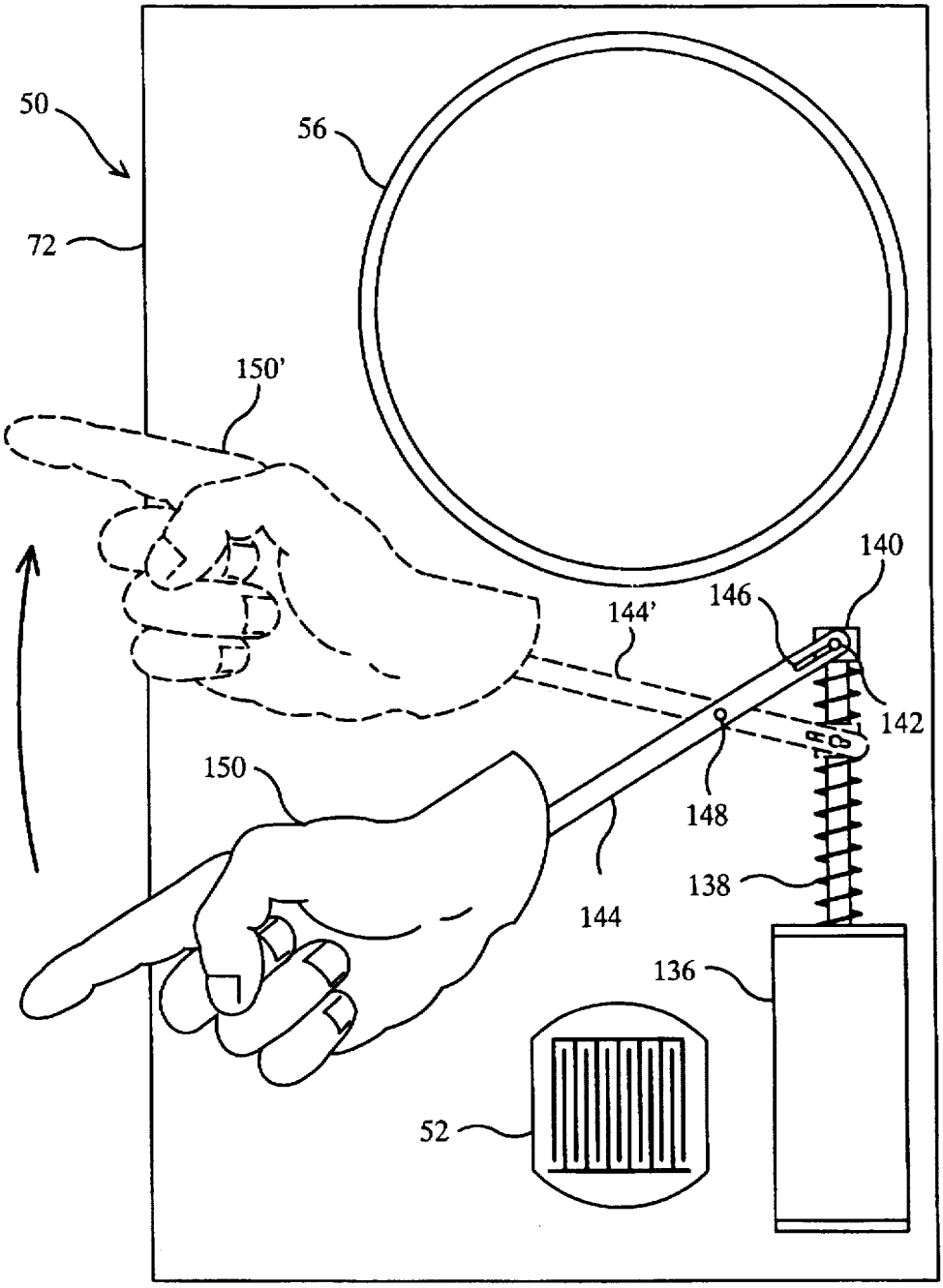
FIG. 24 is a top view of an alerting device containing a solenoid which will move an object in order to provide visual enhancement.
Figure 25:
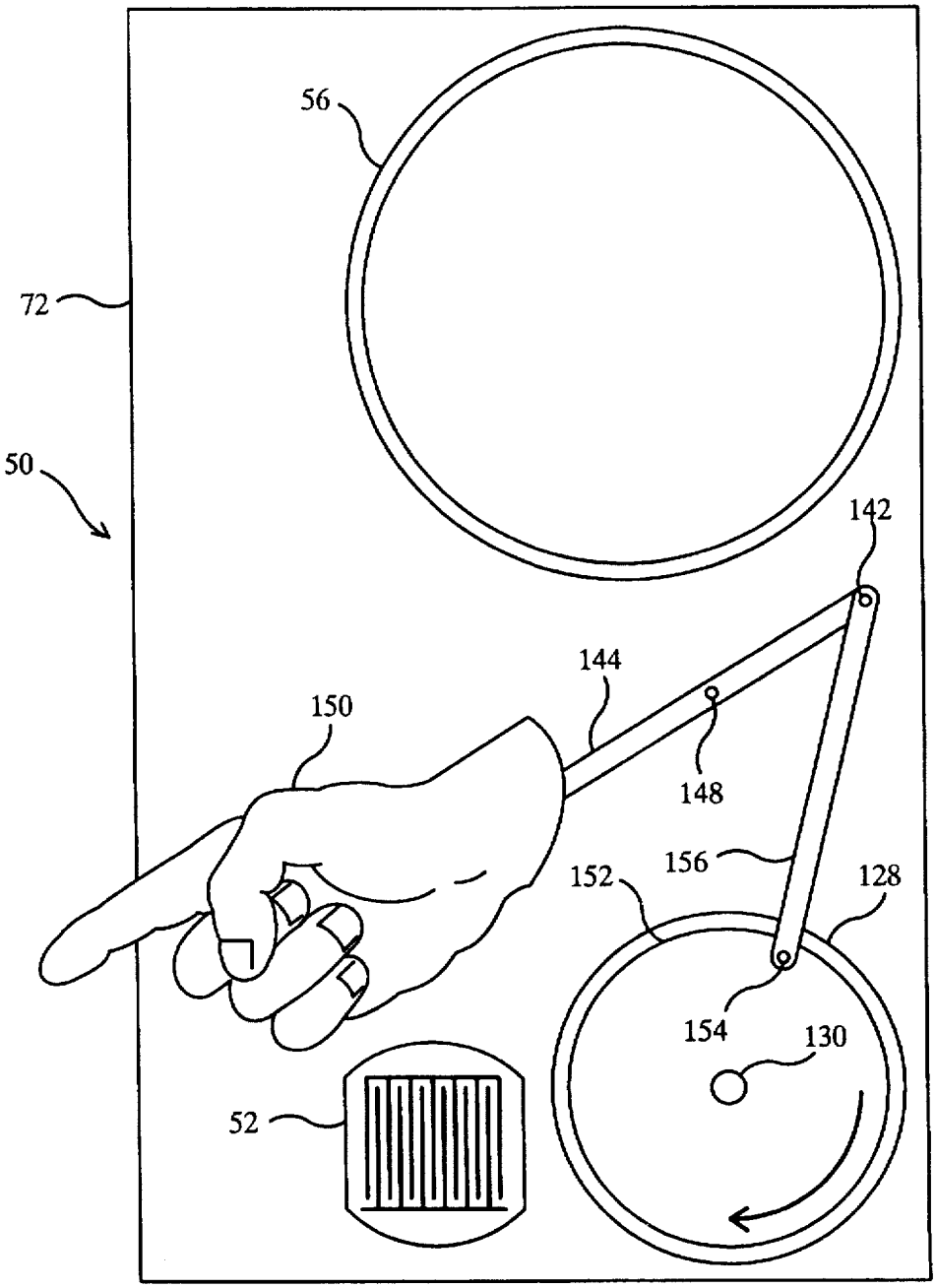
FIG. 25 is a top view of an alerting device containing a motor which will move an object in an oscillating motion so as to provide visual enhancement.
Figure 26:
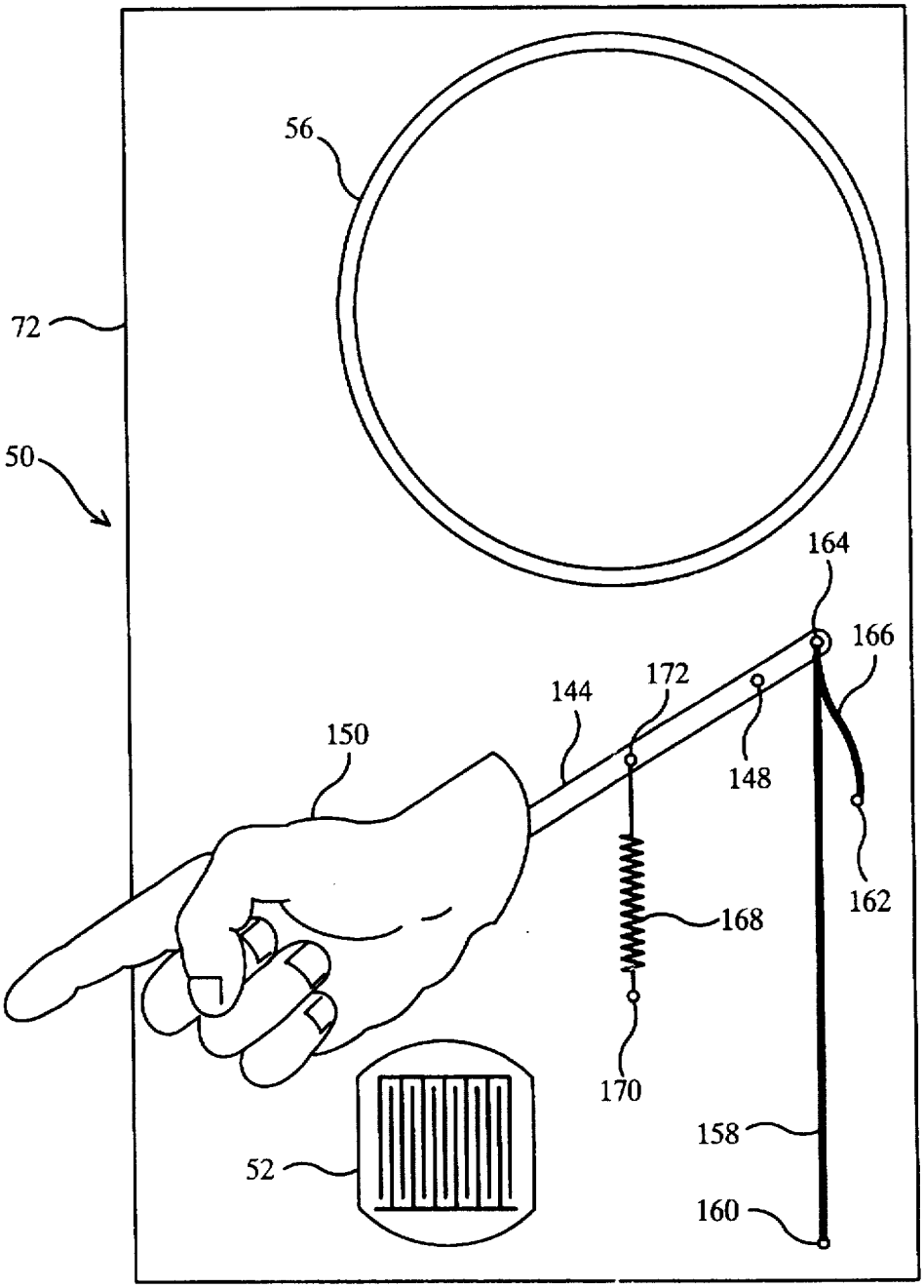
FIG. 26 is a top view of an alerting device containing shape memory alloy wire which will move an object in order to provide visual enhancement.
Figure 27:
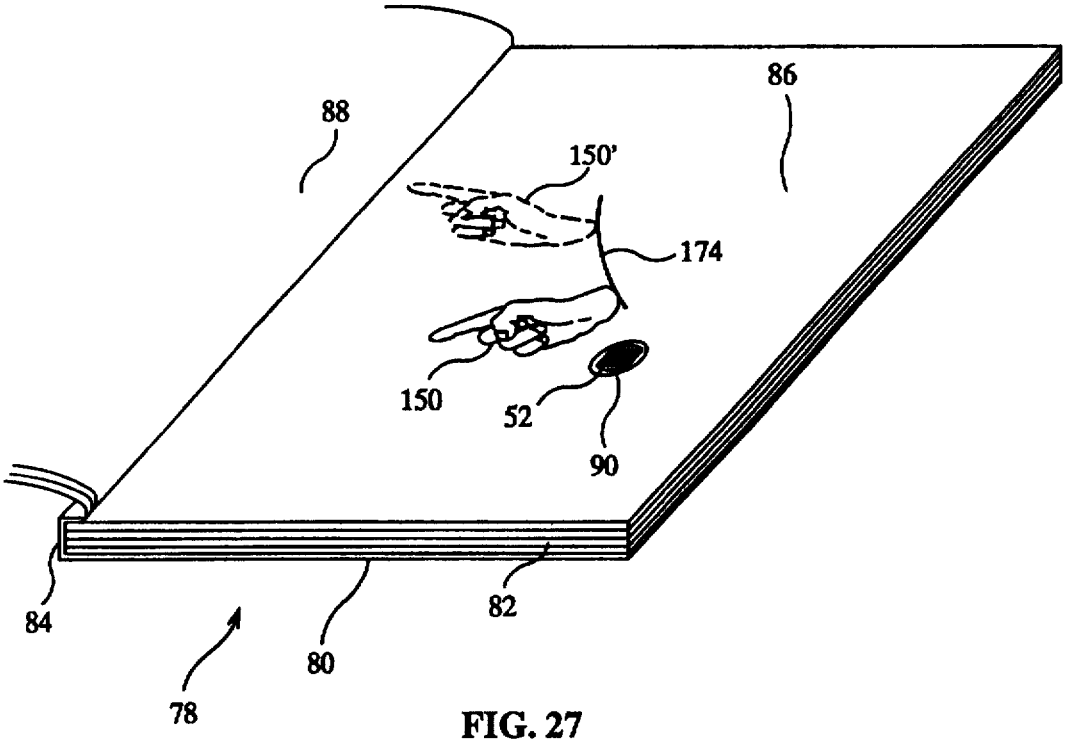
FIG. 27 is a perspective view of a periodical in the opened position in which an alerting device with movement is activated upon exposure to ambient light. The alerting device provides visual enhancement to the printed material.

FIGS. 24, 25, 26, and 27 outline methods which could be used to provide a moving icon having reciprocating or oscillating motions of objects in published material. FIG. 24 depicts an example alerting device 50 incorporating a solenoid 136 in order to move a hand 150 back and forth. A lever 144 is attached to a solenoid shaft 140 with a drive connection pin 142. Lever 144 pivots around a lever pivot pin 148. An electric current causes solenoid shaft 140 to retract into the solenoid 136 body. This in turn moves lever 144 into position as shown by lever 144'. Lever 144 moves hand 150 as shown by hand position 150'. When the electric current ceases, a solenoid return spring 138 causes solenoid shaft 140 to eject from the solenoid 136 body. Lever 144 and hand 150 then return to their original position. Solenoids such as those used in electronic watches or portable tape players work for solenoid 136. Lever 144 could be made out of various materials such as plastic or metal. Pivot pin 148 attaches lever 144 to printed circuit board 72. Pivot pin 148 could be a rivet or other type of mechanical fastener which would allow a pivoting action while maintaining the connection of lever 144 to printed circuit board 72. A slot 146 has been provided in lever 144 to eliminate binding between lever 144 and solenoid shaft 140. Circuitry could be provided that would continuously retrigger solenoid 136 at a desired interval causing a reciprocating action or solenoid 136 could retract shaft 140 as long as photosensor 52 is exposed to ambient light. Alerting device 50 and its parts are not necessarily shown to scale and individual components such as resistors and transistors are not included in FIGS. 24, 25, and 26 for clarity. The actual size of device 50 is typically smaller and will depend on the electrical components used for alerting circuit 70 as depicted in FIG. 1. Solenoid 136 is considered to be an example subset of alerting circuit 70 as previously defined in FIG. 1. An alternate approach for a reciprocating motion is shown in FIG. 25 using motor 128. A cam 152 is attached to motor shaft 130 which will provide a cranking action to lever 156. Cam 152 may be pressure fit or adhesively attached to shaft 130. Lever 156 is attached to cam 152 by cam pin 154. Lever 156 is attached to lever 144 by drive connection pin 142. Lever 156 and cam 152 could also be made of various materials such as metal or plastic. Pivot pin 148, cam pin 154, and drive connection pin 142 could all be rivets or other types of mechanical fasteners which would allow a pivoting action. As cam 152 rotates, it cranks lever 156 which in turn drives lever 144, thus producing an oscillating motion to lever 144. Lever 144 is attached to hand 150, which oscillates with lever 144. Motor 128 could be randomly turned on and off, or turned on as long as light is available for photosensor 52. FIG. 26 shows an alternate embodiment used to obtain movement for alerting device 50. Shape Memory Alloy can be made from a titanium nickel alloy and is sometimes referred to as "nitinol". An example of such an alloy is manufactured in the form of small diameter wires by Toki Corporation of Tokyo, Japan. When nitinol is heated it contracts, thus, a wire made of nitinol would become shorter if it is heated. One way to heat nitinol wire is to pass an electrical current through it, thereby allowing its internal resistance to heat it up. As the wire cools it returns to its original length. A nitinol wire 158 is used in place of solenoid 136. As shown in FIG. 26, one end of nitinol wire 158 is attached to printed circuit board 72 by a rivet 160 which also makes electrical connection from circuit board 72 to nitinol wire 158. The other end of nitinol wire 158 is attached to lever 144 with a rivet 164. A connection wire 166 is also attached to lever 144 by rivet 164, thereby making electrical connection to nitinol wire 158. The other end of connection wire 166 is attached to printed circuit board 72 by rivet 162 or could be soldered to board 72. Nitinol wire 158 is considered to be an example subset of alerting circuit 70 as previously defined in FIG. 1. Alerting circuit 70 would also consist of the control circuitry for nitinol wire 158. One method of heating wire 158 is to simply supply a current pulse to wire 158. A return spring 168 is connected to lever 144 by hooking into a hole 172. The other end of return spring 168 is attached to printed circuit board 72 by hooking into a hole 170. When the electrical current ceases to flow, nitinol wire 158 relaxes and lever 144 returns to its starting position via spring 168. Other methods of heating wire 158 include controlling the amount of current using pulse width modulation. Care must be taken to prevent overheating of nitinol wire 158 since permanent damage will occur otherwise. The amount of heating is dependent on the length and diameter of nitinol wire 158 and the surrounding temperature. FIG. 27 illustrates how alerting device 50 containing reciprocating motion could be installed into magazine 78. A slot 174 is provided in activation page 86 in which hand 150 is inserted. An alternate position of hand 150' is shown along slot 174.

Figure 28:
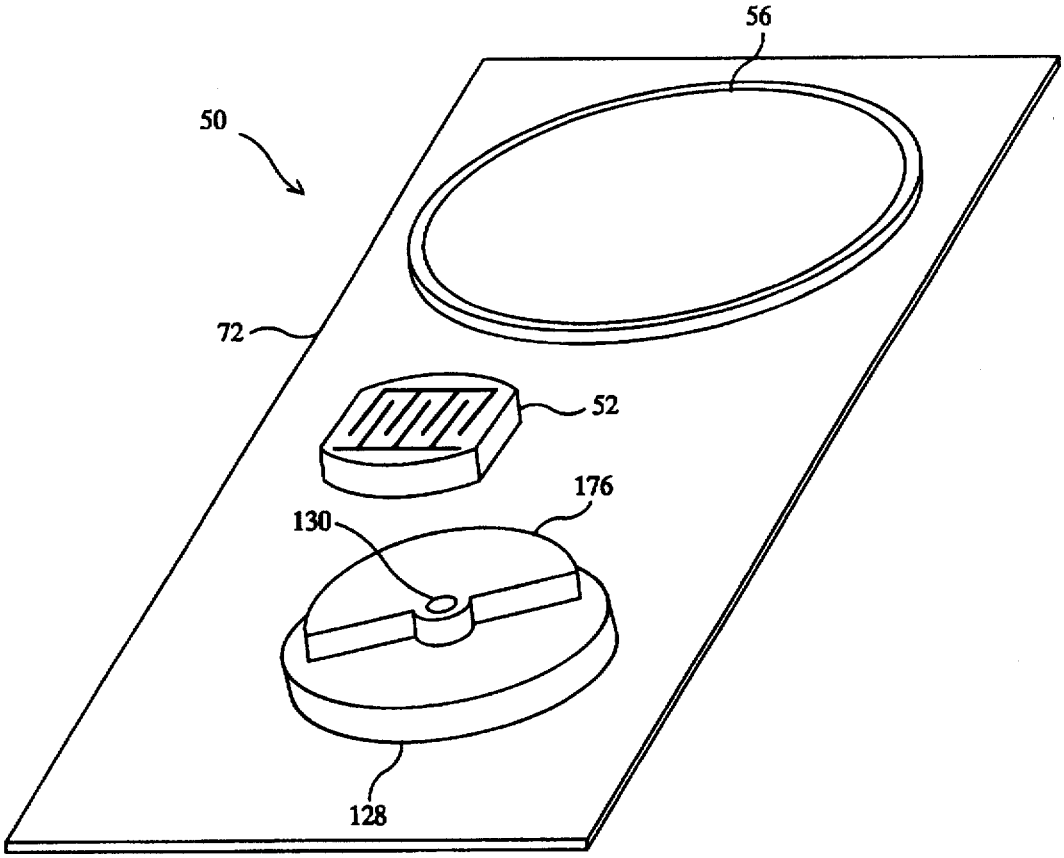
FIG. 28 is a perspective view of an alerting device containing a vibrator which will provide mechanical vibration enhancement.

Mechanical vibration may be provided by alerting device 50 as shown in FIG. 28. An off-balance mass 176 is attached to motor shaft 130. As motor 128 turns shaft 130, a vibration is obtained from mass 176.

Figure 29:
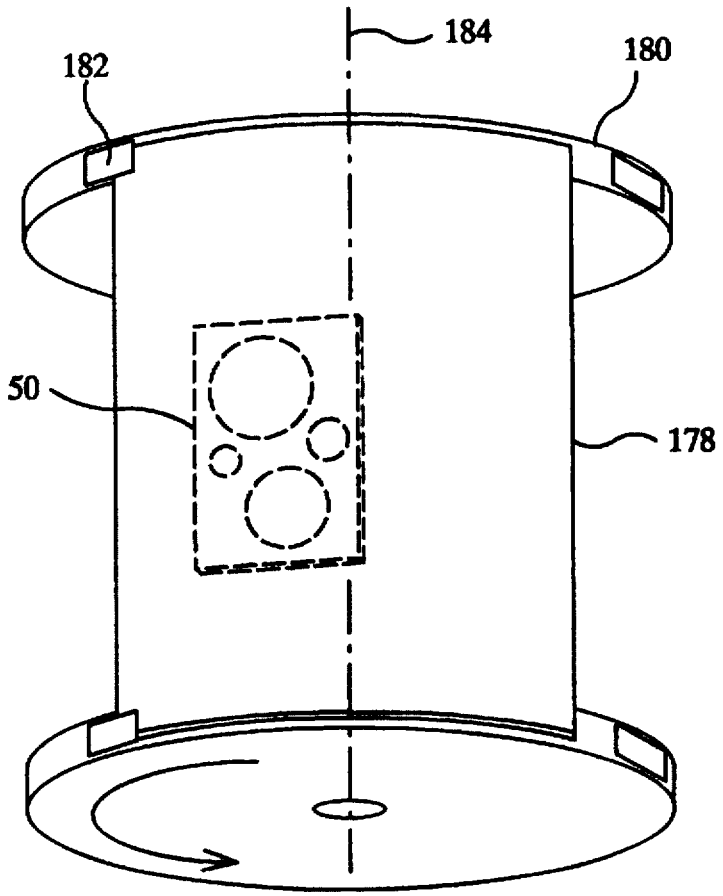
FIG. 29 is a perspective view of a publication signature containing an alerting device wrapped around a packing drum.

An additional embodiment of the present invention is shown in FIG. 29. Alerting device 50 is attached to a magazine signature 178 or a page which is to be bound into a periodical. A signature 178 consists of a single sheet folded in the center to form two pages for the periodical. The two pages are not necessarily consecutive pages. Signatures are common for a saddlewire binding process. Squareback binding usually consists of individual pages bound together on one side as discussed previously. Signature 178 is shown wrapped around a main packing drum 180 used in a saddlewire binding process. Magazine signature 178 is held by a signature gripper 182 and pulled around packing drum 180. The longest dimension of alerting device 50 is aligned parallel with a drum axis 184 of packing drum 180. A higher aspect ratio of alerting device 50 is desirable to allow signature 178 to wrap around packing drum 180 more readily. Thus, a long and narrow alerting device 50 in which the longest dimension is aligned parallel with drum axis 184 will wrap around drum 180 more readily. Different manufacturing techniques may use various types of drums for different purposes during the printing and binding process. The longest dimension of device 50 should be aligned parallel to the axis of the drum with the smallest radius used in the process.

From the description above, a number of advantages of my electronic switch become evident. Thus, what has been provided is a non-mechanical inexpensive switch that will not be damaged or slow down printing or binding equipment used to manufacture a periodical. Also provided is a switch that can be soldered directly to the printed circuit board which eliminates the need to solder interconnecting wires. Further provided is an alerting device which does not require a mechanical interconnection to any other page in the periodical. Additionally provided is an electronic switch that does not have any moving mechanical members which are easily damaged. Soldering the switch directly to the printed circuit board and the elimination of mechanical interconnection to other pages in the periodical has been provided, which allows the alerting device to consist of one unit which may be located anywhere on a printed page. Additionally provided is an alerting device which reduces the need for cutting, folding, threading and gluing in order to form a mechanical switching mechanism. Also provided is an alerting device that requires ambient light for activation as does the printed material for reading. The invention also provides a switch which is easily used with any circuit design and eliminates mechanical tooling costs associated with a mechanical switch. Additionally provided is a switch that can activate an electronic alerting device in a location where audio, visual, and/or vibration enhancement is located as well as activate the enhancement in various other locations of the periodical. Also provided is an alerting device that will work in bound as well as unbound periodicals.

Conclusion, Ramifications, and Scope of Invention

Thus the reader will see that the light sensitive alerting device provides a highly inexpensive and reliable method of enhancing published material. The alerting device is not susceptible to damage and does not slow down printing or binding equipment used to manufacture a periodical. Soldering the switch directly to the board eliminates the necessity of interconnecting wires. The alerting device does not require an interconnection to several pages in the periodical and does not contain moving mechanical switching members which can be easily damaged. The alerting device may be positioned in any desirable location on the printed page. Cutting, folding, threading and gluing in order to form a mechanical switching mechanism has been eliminated. The switch requires ambient light for activation as does the printed material for reading, therefore causing less drain on the battery. The invention also provides a switch which is easily used with any circuit design and eliminates mechanical tooling costs associated with a mechanical switch. Additionally the switch can activate an electronic alerting device in a location where audio, visual, and/or vibration enhancement is located as well as activate the enhancement in various other locations of the periodical. The alerting device will also function in bound as well as unbound periodicals.

While the above description contains many specificities, these should not be construed as limitations on the scope of the invention, but rather as an exemplification of the preferred embodiments thereof. Many other variations are possible. For example, the photosensor and battery could be replaced by a solar cell, which would be connected to an alerting circuit. The switching circuit could trigger a chemical reaction, or a chemical reaction could be triggered by the presence of light without including any electrical circuitry. Accordingly, the scope of the invention should be determined not by the embodiments illustrated, but by the appended claims and their legal equivalents.

I claim:

1. An alerting device for use with a printed publication having at least a first page and a second page, the second page being positioned substantially coincident to the first page when the publication is closed, the alerting device comprising:

an altering circuit integrally formed on a single circuit board, the altering circuit including:

a photosensor that generates a detection signal when exposed to ambient light;

an activation circuit coupled to the photosensor; and an annunciator coupled to the activation circuit, the activation circuit enabling operation of the annunciator to produce an alert signal in response to the detection signal indicating detection of ambient light and opening of the publication.

2. The alerting device according to claim 1 wherein the photosensor integrally formed in the alerting circuit is located on the second page opposed to the first page, and at least one of the first page and the second page includes information which is readable.

3. The alerting device according to claim 2 wherein the alerting circuit comprises a light emitter that acts as the annunciator.

4. The alerting device according to claim 3 wherein the light emitter cooperates with the information to enhance a message being communicated by the information.

5. The alerting device according to claim 2 wherein the alerting circuit comprises an audio emission transducer that acts as the annunciator.

6. The alerting device according to claim 2 wherein the alerting circuit comprises an electric motor coupled to a movable icon that acts as the annunciator.

7. The alerting device according to claim 2 wherein the alerting circuit comprises an electric solenoid coupled to a movable icon that acts as the annunciator.

8. The alerting device according to claim 2 wherein the alerting circuit comprises a shape memory alloy coupled to a movable icon that acts as the annunciator.

9. The alerting device according to claim 2 wherein the alerting circuit comprises a mechanical vibrator that acts as the annunciator.

10. The alerting device according to claim 2 further comprising a third page interposed between the first page and the second page, wherein a first position of the first page serves to block ambient light from the third page and a second position of the first page serves to expose the third page to ambient light, the third page having:

readable information; and a light transmitter that allows ambient light to impinge on the photosensor, wherein the alert is generated when the photosensor positioned on the third page is exposed to ambient light.

11. The alerting device according to claim 10 wherein the photosensor comprises first and second photosensors;

the alerting circuit further comprising means for generating a first and a second alert, the first alert being generated in response to the first photosensor being exposed to ambient light and the second alert being generated in response to the second photosensor being exposed to ambient light; and the light transmitter further allowing ambient light to impinge on the first photosensor while blocking ambient light from impinging on the second photosensor when the third page is in the first position, and wherein the first and second photosensors are exposed to ambient light when the third page is in a second position, thereby generating the first alert when the third page is in the first position and generating the second alert when the third page is in the second position.

12. The alerting device according to claim 11 wherein the light transmitter includes an opening in the third page for allowing ambient light to impinge on the first photosensor when the third page is in the first position.

13. The alerting device according to claim 11 wherein the light transmitter uses ink to block ambient light from impinging on the second photosensor when the third page is in the first position.

14. The alerting device according to claim 1 wherein the photosensor comprises one of a phototransistor, a photovoltaic cell, and a photoresistor.

15. An alerting device for use with a printed publication, the alerting device comprising:

an altering circuit integrally formed on a single circuit board and attached to a page using a pigmented encapsulation material the altering circuit including:

a photosensor that generates a detection signal when exposed to ambient light;

a light generating source having a radiating surface for generating a visual alert; and an activation circuit for driving the light generating source, the single circuit board functioning to integrate the light generating source and the activation circuit; the pigmented encapsulation material substantially encapsulating at least one surface of the alerting circuit and a substantial portion of the light generating source, except that the radiating surface of the light generating source is substantially free of the pigmented encapsulation material to allow radiation of light therefrom.

16. The alerting device according to claim 15 wherein the photosensor comprises one of a phototransistor, a photovoltaic cell, and a photoresistor.

17. A method for binding a substantially inflexible alerting circuit into a printed publication comprising at least one flexible page, the alerting circuit having a length dimension substantially longer than a width dimension so as to minimize any pressures and bending associated with a publishing and a binding process, the binding process using a circular drum rotating on an axis, the method comprising the steps of:

aligning the length dimension of the alerting circuit in parallel with the axis of rotation of the drum;

affixing the alerting circuit to the page; and passing the alerting circuit and the page over the drum to complete the binding process.

18. The method according to claim 17 wherein the alerting circuit includes a photosensor and the page includes an area for receiving the photosensor, wherein said step of affixing further comprises the step of:

aligning the photosensor with the area for receiving the photosensor.

19. The method according to claim 17 wherein the alerting circuit includes a light emitter and the page includes an area for receiving the light emitter, wherein said step of affixing further comprises the step of aligning the light emitter with the area for receiving the light emitter.

20. The method according to claim 17 wherein the alerting circuit includes a movable icon and the page includes an area for receiving the movable icon, wherein said step of affixing further comprises the step of aligning the movable icon with the area for receiving the movable icon.

* * * * *